US008312640B2

(12) United States Patent
Taniguchi et al.

(10) Patent No.: US 8,312,640 B2
(45) Date of Patent: Nov. 20, 2012

(54) CLOTH DRYER

(75) Inventors: Mitsunori Taniguchi, Shiga (JP); Hideo Nisihata, Shiga (JP); Tosiaki Andou, Shiga (JP); Masayuki Tanaka, Nara (JP)

(73) Assignee: Panasonic Corporation, Osaka (JP)

( * ) Notice: Subject to any disclaimer, the term of this patent is extended or adjusted under 35 U.S.C. 154(b) by 331 days.

(21) Appl. No.: 12/601,370

(22) PCT Filed: May 28, 2008

(86) PCT No.: PCT/JP2008/001325

§ 371 (c)(1),
(2), (4) Date: Nov. 23, 2009

(87) PCT Pub. No.: WO2008/146488

PCT Pub. Date: Dec. 4, 2008

(65) Prior Publication Data

US 2010/0170101 A1 Jul. 8, 2010

(30) Foreign Application Priority Data

May 31, 2007 (JP) ..... 2007-144804
Apr. 21, 2008 (JP) ..... 2008-109813

(51) Int. Cl.
*D06F 58/04* (2006.01)
*F28F 13/00* (2006.01)
*F26B 21/08* (2006.01)

(52) U.S. Cl. ..... 34/134; 34/73; 34/77; 34/78

(58) Field of Classification Search ..... 34/130, 34/131, 132, 134, 72, 73, 74, 77, 78
See application file for complete search history.

(56) References Cited

U.S. PATENT DOCUMENTS 4,103,433 A * 8/1978 Taylor ..... 34/86
5,343,632 A * 9/1994 Dinh ..... 34/507
6,026,891 A 2/2000 Fujiyoshi et al.

FOREIGN PATENT DOCUMENTS

EP 1780488 A1 5/2007
JP 07-178289 A 7/1995

(Continued)

OTHER PUBLICATIONS

English translation of JP 11028926A.*

(Continued)

*Primary Examiner* — Jiping Lu
(74) *Attorney, Agent, or Firm* — Brinks Hofer Gilson & Lione

(57) ABSTRACT

A cloth dryer includes heat-pump (30), rotary tub (5) for accommodating clothes (4) to be dried, blower (12) for supplying air heated by heat radiator (23) to rotary tub (5), and heat-exchange air flow paths (22, 24) for circulating the air stayed in rotary tub (5) through heat radiator (23) via heat absorber (21). Fins striding over heat absorber (21) and heat radiator (23) allow integrating absorber (21) and radiator (23) into one body which can be thus placed within air-flow paths (22, 24). Heat-transfer reducing section (32) is formed on the fins between heat absorber (21) and heat radiator (23) for reducing the heat transfer via the fins between heat absorber (21) and heat radiator (23). The foregoing structure can prevent frost and ice produced on heat absorber (21) from growing, so that a compact cloth dryer excellent in drying performance is obtainable.

15 Claims, 16 Drawing Sheets

FOREIGN PATENT DOCUMENTS

| | | | | |
|---|---|---|---|---|
| JP | 10-160378 | A | | 6/1998 |
| JP | 10300271 | A | * | 11/1998 |
| JP | 11028926 | A | * | 2/1999 |
| JP | 2002-310584 | A | | 10/2002 |
| JP | 2006-345968 | A | | 12/2006 |
| KR | 10-0259598 | B1 | | 6/2000 |

OTHER PUBLICATIONS

English translation of JP 10300271 A.*

International Search Report for International Application No. PCT/JP2008/001325, dated Jul. 15, 2008, 1 page.

* cited by examiner

CLOTH DRYER

This application is a 371 application of PCT/JP2008/001325 having an international filing date of May 28, 2008, which claims priority to JP2007-144804 filed May 31, 2007 and JP2008-109813 filed Apr. 21, 2008, the entire contents of which are incorporated herein by reference.

TECHNICAL FIELD

The present invention relates to a cloth dryer to be used in a household washer-dryer for drying clothes.

BACKGROUND ART

A cloth dryer having a built-in heat pump, which allows effective use of heat, has been proposed recently (disclosed in e.g. Patent Literature 1). The heat pump is formed of the following structural elements:

a compressor for compressing a refrigerant;

a heat radiator for exchanging heat between the refrigerant, which has been compressed by the compressor and turned into a high temperature and high pressure state, and the ambient air, thereby radiating the heat from the refrigerant;

a throttling section for decompressing the highly pressurized refrigerant having undergone the heat radiator;

a heat absorber for exchanging heat between the refrigerant, which has been decompressed by the throttling section and turned into a low pressure and low temperature state, and the ambient air, thereby depriving the ambient air of the heat; and a pipe line for the refrigerant to travel through the foregoing structural elements one by one.

The cloth dryer including the foregoing heat pump works this way: Drying air blown by a blower deprives clothes placed in a rotary drum of water, so that the air becomes humid. Then the blower transmits the air to the heat absorber of the heat pump through a circulating duct. The drying air of which heat is deprived by the heat absorber is dehumidified and conveyed to the heat radiator to be heated, and then circulated into the rotary drum again. The drying air repeats the foregoing steps, whereby the clothes are dried.

The structure disclosed in Patent Literature 1 allows the water vaporized from the clothes to form dew on the heat absorber, so that the clothes can be dried efficiently. On top of that, heat of hot wind containing the water from the clothes is absorbed by the heat absorber, and the heat is transmitted to the compressor via the refrigerant, which is heated by the compressor, and the heat of the refrigerant is radiated by the heat radiator for heating again the hot wind. The heat can be thus efficiently used.

The dryer using the heat pump disclosed in Patent Literature 1 allows the heat absorber to dehumidify the dumped clothes, so that the heat absorber can work as a heat absorbing source of a refrigerating cycle. Electric power is input for circulating the refrigerant, so that the heat radiator can heat the air for further vaporizing the water from the clothes. The foregoing steps are repeated.

However, the conventional cloth dryer using the heat pump discussed above takes a time before the clothes are warmed and ready for being used as the heat absorbing source of the refrigerating cycle, and the compressor resists increasing a pressure before the heat absorbing source is ready.

When the clothes are in a low temperature state or the cloth dryer per se is in a low temperature state because an ambient temperature is low, e.g. in winter, the air circulating through the heat absorber and the heat radiator, which form the refrigerating cycle, falls into a low temperature state. In such a case, the refrigerant flowing in the heat absorber should be controlled at a temperature lower than the temperature of this air in order to carry out the heat exchange between the refrigerant and the air, otherwise, the refrigerant cannot absorb the heat from the air.

The refrigerant flowing in the heat absorber thus remains not higher than 0° C. until the temperature of the circulating air rises to a given temperature. The water forms dew on the heat absorber and grows to frost or ice, which attaches to the surface of the heat absorber. As a result, the frost or ice attached to the surface blocks the circulating air and also disturbs the heat exchange between the refrigerant and the air.

In the heat absorber, the air is cooled greater as the air runs further down the flow, so that the temperature at the downstream becomes the lowest. The frost or ice thus starts growing from the downstream and blocks the circulating air, and also disturbs the heat exchange between the refrigerant and the air.

The frost or ice repeats growth and meltdown on the surface of the heat absorber until the circulating air is warmed to a given temperature. The water melted down drops to the underside of the heat absorber and is frozen again. The refrozen ice-layer on the heat absorber blocks the circulating air and also disturbs the heat exchange between the refrigerant and the air.

On top of that, when the heat exchange between the refrigerant and the air is carried out unsatisfactorily due to the growth of frost or ice on the heat absorber, the refrigerant cannot fully evaporate and is sucked into the compressor in a liquid state. This phenomenon will affect the reliability of the compressor.

Patent Literature 2 discloses another structure of the heat pump used as a heat exchanger for a dehumidifier. A heat absorber and a heat radiator of this heat pump share fins and form a heat exchanger in one body, and slits are provided at the fins between the absorber and the radiator. This slit allows suppressing the flow of heat between the absorber and the radiator, so that they can be downsized.

However, in the heat exchanger disclosed in Patent Literature 2, pipe-lines for the refrigerant at the absorber and the radiator share the fin and the pipe-lines are adjacent to each other. The absorber and the radiator thus invite heat transfer through the fins between the adjacent pipe-lines, so that the efficiency of the heat exchange is lowered.

On top of that, when the air traveling through the heat exchanger is at a high temperature, the heat transfer discussed above makes it difficult for the heat radiator to maintain a refrigerant overcooled region, so that the dehumidifying capacity is lowered.

Another heat exchanger for an air-conditioner or a refrigerator is disclosed in, e.g. Patent Literature 3. In this heat exchanger, a rather longer cut section is provided at the following two places respectively: at a heat transfer pipe where a refrigerant enters and a rather higher temperature is kept, and at another heat transfer pipe where the refrigerant exits and a rather lower temperature is kept. This structure allows cutting off efficiently the heat conduction between the heat transfer pipes where temperatures different greatly from each other are kept, so that a greater refrigerant overcooled region can be obtained. As a result, a greater amount of heat exchange, i.e. a greater capacity of heat exchange, can be expected.

The heat exchanger disclosed in Patent Literature 3; however, in a case where multiple rows of refrigerant pipes exist between the entrance and the exit for the refrigerant, heat transfer occurs through the fins between the adjacent refrigerant pipes. The foregoing structure thus incurs degradation in the efficiency of maintaining a high temperature at the heat radiator, or degradation in the efficiency of maintaining a low temperature at the heat absorber. As a result, no further improvement in the efficiency can be expected regrettably.

Patent Literature 1: Unexamined Japanese Patent Application Publication No. H07-178289

Patent Literature 2: Unexamined Japanese Patent Application Publication No. 2002-310584

Patent Literature 3: Granted Japanese Patent Publication No. 3769085

DISCLOSURE OF THE INVENTION

The present invention aims to provide a clothes dryer that can suppress the growth of frost or ice at a heat absorber even at a low ambient temperature. It also aims to provide a clothes dryer that expects a greater efficiency respectively in a heat absorber and a heat radiator. This clothes dryer allows the heat radiator to maintain an overcooled region by a refrigerant even when the air traveling at a high humidity through the heat exchanger. The clothes dryer thus can prevent the dehumidifying capacity from lowering and be excellent in drying efficiency.

The clothes dryer of the present invention comprises the following structural elements:

a heat pump including:

a compressor for compressing a refrigerant;

a heat radiator for exchanging heat between the refrigerant, compressed by the compressor into a high temperature and high pressure state, and the ambient air, thereby radiating the heat from the refrigerant;

a throttling section for decompressing the highly pressurized refrigerant having undergone the heat radiator;

a heat absorber for exchanging heat between the refrigerant, decompressed by the throttling section into a low pressure and low temperature state, and the ambient air, thereby depriving the ambient air of the heat; and a pipe line connecting the foregoing structural elements to each other sequentially for the refrigerant to travel through them one by one, a tub for accommodating materials to be dried;

a blower for supplying air heated by the heat radiator;

a heat exchange air-flow path for circulating air staying in the tub to the heat radiator via the heat absorber; and fins striding over the heat radiator and the heat absorber for integrating them into one body and placing the one body within the heat exchange air-flow path.

The heat radiator and the heat absorber are respectively formed of refrigerant pipes which meander and extend along a given direction through the fins. A heat-transfer reducing section is placed extending along the same direction as the refrigerant pipe extends, and the heat-transfer reducing section works for suppressing the heat transfer through the fins between the radiator and the absorber.

The structure discussed above allows transferring the heat from the heat radiator to the heat absorber through the fins. As a result, even if a low ambient temperature grows frost, whereby the heat absorber is blocked up, the frost can be melted as the temperature of the refrigerant rises, so that drying efficiency can be prevented from lowering.

On top of that, since the heat absorber and the heat radiator are integrated into one body, the heat pump can be downsized, so that a compact clothes dryer excellent in the drying efficiency is obtainable.

The presence of the heat-transfer reducing section at the fins striding over the absorber and the radiator allows suppressing the heat transfer between the absorber and the radiator, so that degradation in the efficiency of dehumidifying and drying can be prevented.

DESCRIPTION OF REFERENCE SIGNS

Figure 1:
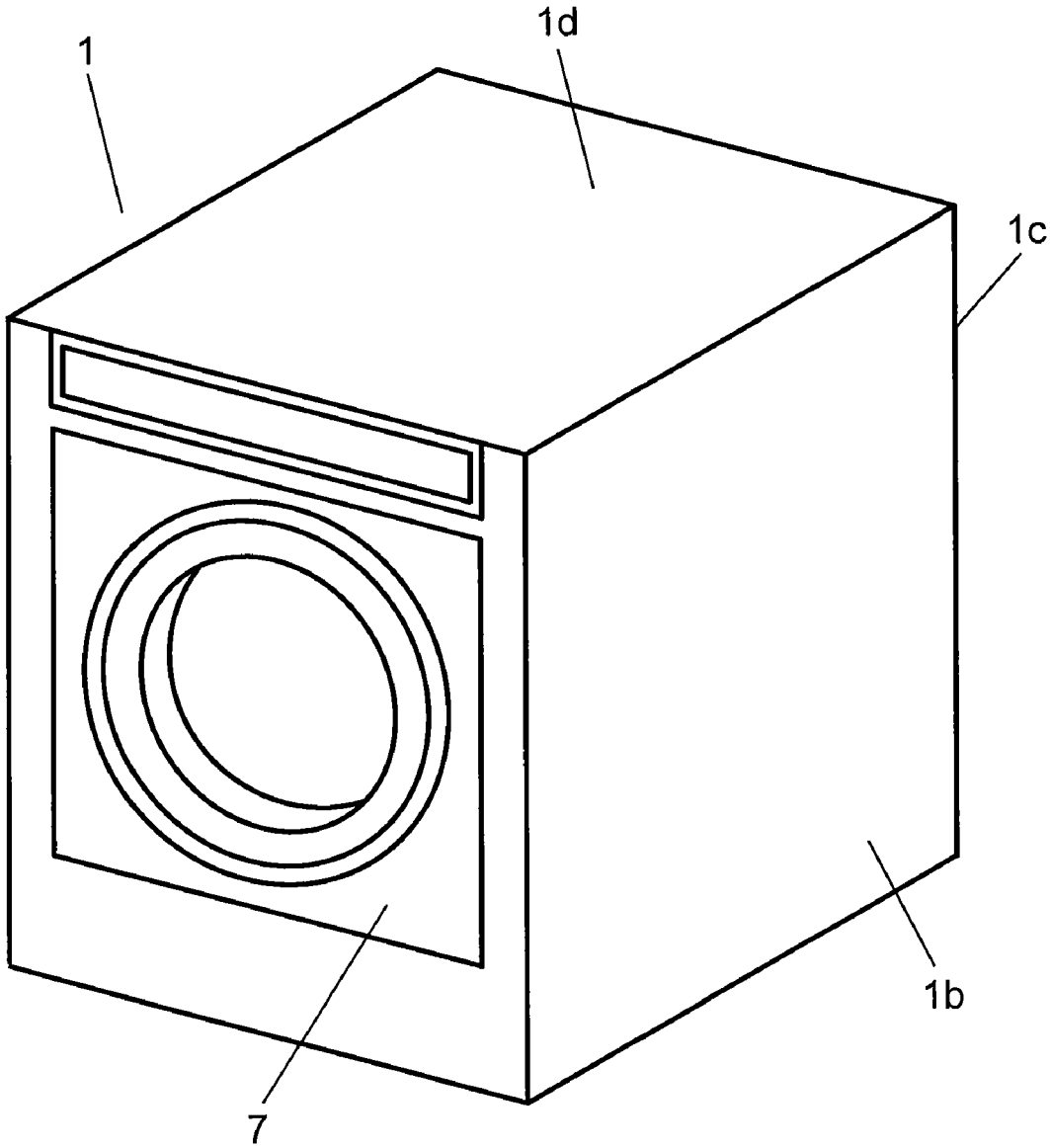
FIG. 1 shows a perspective appearance of a washer/dryer including a cloth dryer in accordance with a first embodiment of the present invention.

1 housing
4 clothes (subject to be dried)
5 rotary tub (tub)
12 blower (blowing section)
21 heat absorber
21A, 23A refrigerant entrance
21B, 23B refrigerant exit
22 air-flow path in heat absorber (heat exchange air-flow path)
23 heat radiator
24 air-flow path in heat radiator (heat exchange air-flow path)
25, 25*a*, 25*b* fins
26 compressor
27 throttling section

28 pipe line
30 heat pump
32, 32*a*, 32*d*, 32*e* cut (heat-transfer reducing section)
32*b* cut (heat-transfer reducing section at over-heated side)
32*c* cut (heat-transfer reducing section at over-cooled side)
32*f* cut (heat-transfer reducing section at the heat absorbing side)
33 through hole (vacant through-hole)
55 refrigerant over-heated region
56 refrigerant in two-phase region
57 refrigerant over-cooled region
60 a row including a refrigerant over-heated region
61 a row adjacent to the row including a refrigerant over-heated region
62, 71 a row including refrigerant over-cooled region
70 low temperature region
72 a row adjacent to the row including a refrigerant over-cooled region

PREFERRED EMBODIMENTS FOR CARRYING OUT THE INVENTION

Exemplary embodiments of the present invention are demonstrated hereinafter with reference to the accompanying drawings. The present invention is not limited to those embodiments.

Embodiment 1

Figure 2:
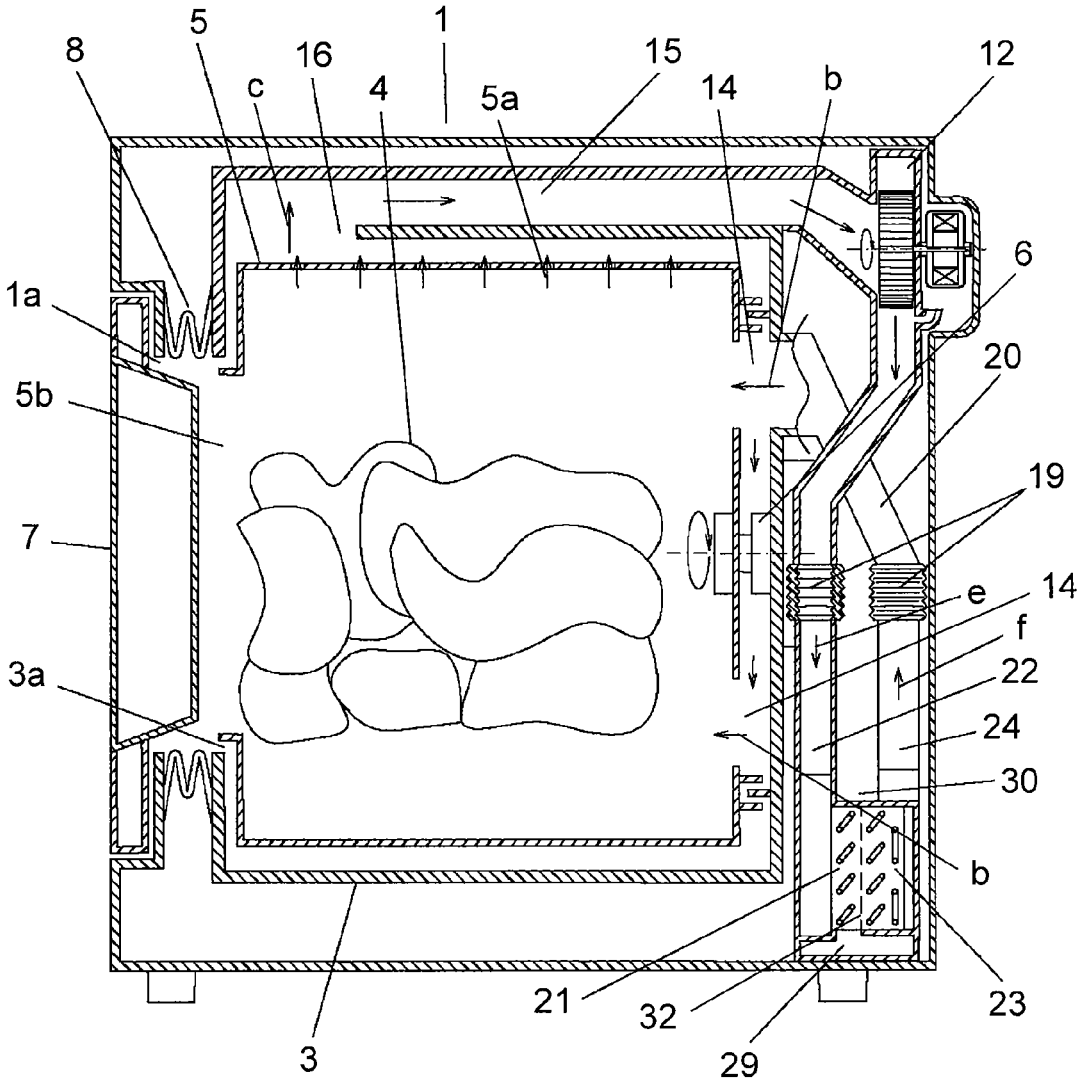
FIG. 2 shows a partially cut-away sectional view of a drying operation viewed from a lateral side of the washer/dryer.
Figure 3:
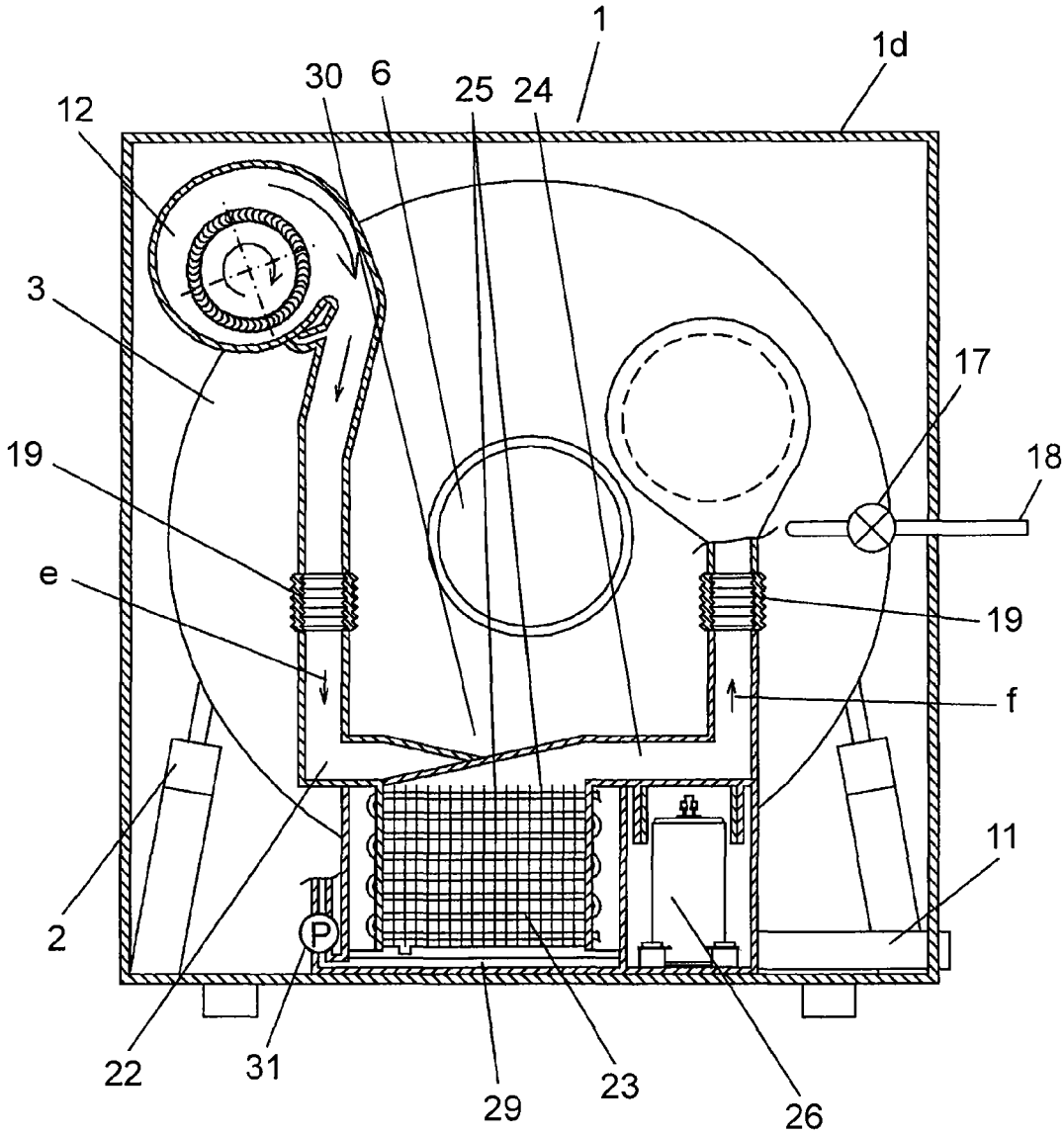
FIG. 3 shows a partially cut-away sectional view of the drying operation viewed from a rear side of the washer/dryer.
Figure 4:
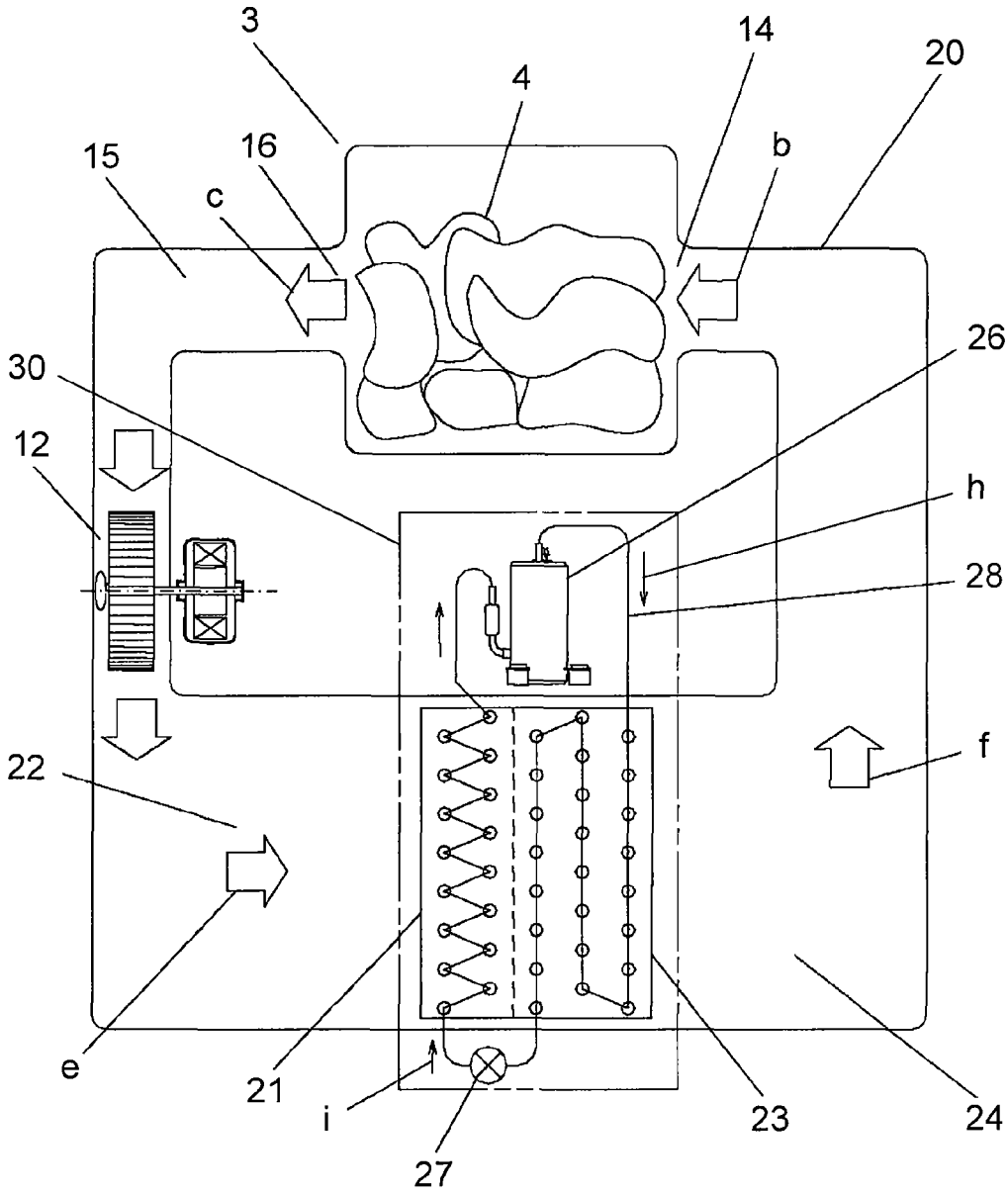
FIG. 4 schematically illustrates an operation of the washer/dryer systematically.
Figure 5:
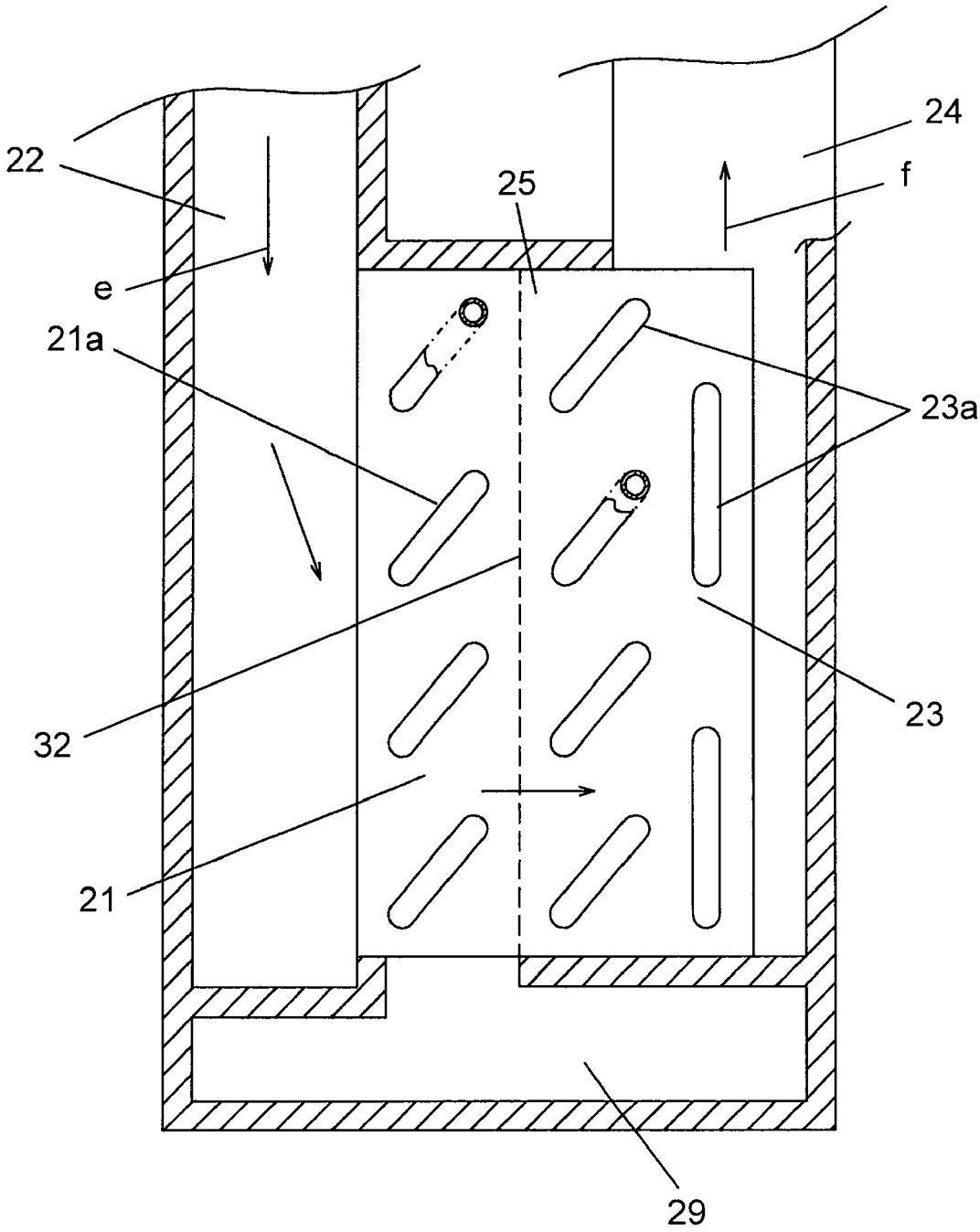
FIG. 5 shows an enlarged sectional view of a heat exchange air-flow path in the washer/dryer.

FIG. 1 shows a perspective appearance of a washer/dryer including a cloth dryer in accordance with the first embodiment of the present invention. FIG. 2 shows a sectional view of the washer/dryer shown in FIG. 1 and in drying operation, the washer/dryer is partially cut-away and viewed from right lateral face 1*b* of the housing. FIG. 3 shows the washer/dryer shown in FIG. 1 and in drying operation, the washer/dryer is partially cut-away and viewed from rear face 1*c* of the housing. FIG. 4 schematically illustrates a structure of a heat pump mounted in the washer/dryer and the flow of drying air. FIG. 5 shows an enlarged sectional view of a heat exchange air-flow path running in the washer/dryer.

As shown in FIG. 1-FIG. 5, housing 1 of the washer/dryer includes cylindrical water tub 3 therein resiliently supported by multiple suspensions 2, which absorb the vibration of water tub 3 during washing or spin-drying operation.

Water tub 3 includes cylindrical rotary tub 5 therein for accommodating clothes 4, and is driven by motor 6 on a horizontal axis. Housing 1 has opening 1*a* and door 7, which opens/closes opening 1*a*, at the front. A user inputs or takes out clothes 4 to/from water tub 3 through opening 1*a*. Water tub 3 and rotary tub 5 also have openings 3*a* and 5*b* respectively at their front faces. Opening 3*a* of water tub 3 connects with opening 1*a* of housing 1 via bellows 8 in a water tight manner. Water tub 3 has a drain hole (not shown) at the bottom for draining wash-water. The drain hole connects with drain hose 11 via a drain valve (not shown).

Blower 12 is placed on an outer wall of water tub 3 at a corner space (located at an upper section of housing 1) formed by top face 1*d* of housing 1 and water tub 3. A heat exchanger of heat pump 30 is placed at a lower section of the rear face of housing 1. The heat exchanger includes heat-absorber air-flow path 22, a part of a heat exchange air-flow path, for running the air to heat absorber 21 along arrow mark "e", and heat radiator air-flow path 24, also a part of the heat exchange air-flow path, for running the air to heat radiator 23 along arrow mark "f".

On top of that, heat absorber 21 and heat radiator 23 are respectively formed of meandering refrigerant pipes 21*a* and 23*a* extending along one direction (vertical direction in FIG. 5). Heat absorber 21 and heat radiator 23 share a large number of flat fins 25 placed in parallel with each other and forming right angles with respect to the paper of FIG. 5. Extension of refrigerant pipes 21*a* and 23*a* through fins 25 allows integrating absorber 21 and generator 23 together in one body. Heat radiator 23 in particular includes two rows of refrigerant pipes 23, i.e. one row extends vertically with refrigerant pipes 23*a* in a slant and meandering manner, and the other row extends vertically with pipes 23*a* in an upright manner. In other words, heat radiator 23 forms rows refrigerant pipes at the heat radiating side where multiple refrigerant pipes 23*a* are arranged in parallel. Each one of pipes 23*a* is connected to each other at its end, thereby forming a single refrigerant flow-path (corresponding to the refrigerant flow path at radiating side of the present invention). The structure discussed above is depicted in FIG. 4 which illustrates the routing of pipe line 28 and FIG. 5 which shows refrigerant pipes 21*a* and 23*a* partially cut away.

Refrigerant pipes 21*a* and 23*a* are made of well-known metal such as copper, copper alloy, aluminum, or aluminum alloy. Fin 25 is made of also well-know metal such as aluminum or aluminum alloy and forms a plate-like shape. Heat absorber 21 and heat radiator 23 can be assembled with a known method, so that the description thereof is omitted here.

Multiple cuts 32 are formed like a dashed line between heat absorber 21 and heat radiator 23 on fin 25. Cuts 32 should be formed at least at the place where refrigerant pipes of absorber 21 and radiator 23 come closer to each other, and allow splitting fin 25 into the heat absorbing side and the heat generating side. Small connecting sections between respective cuts 32 form a heat conduction area (heat conduction section) between absorber 21 and generator 23.

In this first embodiment, cuts 32 are formed as a heat-transfer reducing section; however, fins 25 can be punched out by a metal die to form cutout sections (not shown) with a fine width at the same place as cuts 32 so that an advantage similar to what is discussed above can be obtainable. Since the cutout sections reduce the area of fin 25, forming of cuts 32 is better than forming of the cutout sections because a heat-exchanging area between fins 25 and the air can be maintained. Cuts 32 or the cutout sections form the heat-transfer reducing section of the present invention.

As discussed above, the sharing of fins 25 and the forming of cuts 32 as small as a dashed line allows preventing the air running through heat absorber 21 and heat radiator 23 from passing through cuts 32 and interfering with the adjacent air current (air current running on the rear face of fin 25). As a result, the air can travel efficiently from heat absorber 21 to heat generator 23.

In the case of using an air-flow circuit in which heat absorbing air-flow path 22 is placed close to heat generating air-flow path 24 and the air makes a U-turn after traveling through the heat exchanger, the air current traveling through heat absorber 21 and heat radiator 23 flows smooth. On top of that, heat absorbing air-flow path 22 and heat generating air-flow path 24 can be formed unitarily with the housing of absorber 21 and generator 23 into one body by resin molding. As a result, the heat pump can be downsized and mounted into a limited space on the rear face of housing 1 at a lower section.

As shown in FIG. 2, drying air blown by blower 12 runs through heat absorber 21 placed in heat-absorbing air-flow path 22 via flexible connection pipe 19 shaped like bellows as arrow mark "e" shows. Then the drying air travels through heat radiator 23 placed in heat-generating air-flow path 23, flexible pipe 19 and blowing air-duct 20 as arrow mark "f" shows. Then as shown with arrow mark "b", the air current flows into rotary tub 5 through air-inlet 14 and passes through clothes 4 in tub 5. Finally, as shown with arrow mark "c" the air current runs through circulating duct 15 via discharging outlet 16 placed at the upper section of tub 5 and returns to blower 12. The drying air blown by blower 12 circulates in a similar way to what is discussed above.

Heat pump 30 uses a flammable refrigerant because of the environmentally friend properties, and as shown in FIG. 4, heat pump 30 is formed of compressor 26, heat radiator 23, throttling section 27, heat absorber 21, and pipe line 28 that connects the foregoing elements sequentially for the refrigerant can flow through them one by one. The refrigerant thus circulates along the direction indicated by arrow marks "h" and "i", thereby achieving a heat-pump cycle.

Compressor 26 used in this embodiment is a vertical type compressor for compressing a refrigerant. Heat radiator 23 radiates heat by exchanging the heat between the ambient air and the refrigerant kept at a high temperature and a high pressure due to the compression by compressor 26. Throttling section 27 is formed of a throttle valve or capillary tubes for decompressing the refrigerant kept at a high pressure while the refrigerant has been heat-dissipated by heat radiator 23. Heat absorber 21 exchanges heat between the ambient air and the refrigerant kept at a low temperature and a low pressure due to the decompression by throttling section 27, thereby depriving the ambient air of heat.

Water reservoir 29 is placed below heat absorber 21 for receiving dew drops attached to absorber 21 placed in heat absorbing air-flow path 22. The dew drops pooled in water reservoir 29 are pumped up by drain pump 31 and discharged outside the washer/dryer through drain hose 11.

The washer/dryer discussed above operates this way: In a washing step, water feeding valve 17 is opened while the drain valve (not shown) is closed for feeding the tap water into water tub 3 through water supply hose 18 connected to a cock of a water pipe. The water is fed until a water level reaches a given level in water tub 3, then motor 6 is driven for rotating rotary tub 5 accommodating clothes 4 and the washing water therein. The washing step is thus carried out.

In a rinsing step next to the washing step, the tap water is fed into water tub 3 as is done in the washing step, then rotary tub 5 is rotated for rinsing clothes 4.

In a dehydrating step next to the rinsing step, the drain valve is opened for discharging the water in water tub 3 to the outside of the washer/dryer, and then rotary tub 5 accommodating clothes 4 is spun in one direction with motor 6 so that centrifugal force can be generated for dehydrating clothes 4.

When the dehydrating step is completed, the step moves on to a drying step shown in FIG. 4. In this drying step, rotary tub 5 is driven at a given speed, and vertical type compressor 26 of heat pump 30 starts working as well as blower 12 starts working.

The refrigerant is thus compressed by compressor 26 into gaseous refrigerant in a high-pressure and high-temperature state. The gaseous refrigerant flows into heat radiator 23 as shown with arrow mark "h", and is cooled by exchanging heat with the air flowing between each one of fins 25, the gaseous refrigerant thus turns into liquid refrigerant.

The liquid refrigerant then flows to throttling section 27 where it undergoes adiabatic expansion and falls into a low-temperature and low-pressure state or turns into two-phase refrigerant in which liquid and gas are mixed, and then flows to heat absorber 21 along arrow mark "i" in FIG. 4.

In heat absorber 21, the refrigerant exchanges heat with the air flowing between each one of fins 25 for being heated, and turns into gaseous refrigerant, which then returns to compressor 26. The refrigerant circulates in heat pump 30 as discussed above.

The air, which has deprived clothes 4 of water, travels through blower 12 via discharging outlet 16 of water tub 3, and flows into heat absorber 21 as indicated by arrow mark "c". The air forms dew on the surface of heat absorber 21 which has been cooled to not higher than a dew point, whereby the air is dehumidified.

The air then flows into heat radiator 23 for being humidified, so that the air falls into a high-temperature and low-humidity state. The air then travels through air duct 20 and flows into water tub 3 as indicated by arrow mark "f". Rotary tub 5 in water tub 3 is driven by motor 6, so that clothes 4 are rolling in tub while they are agitated up and down.

The air in a high-temperature and low-humidity state flows in rotary tub 5, and deprives clothes 4 of water when the air passes through clothes 4, and the damped air runs through circulation duct 15 and blower 12 via discharging outlet 16, and flows into heat absorber 21 again. The air circulates in the washer/dryer as discussed above.

The dew water formed on the surface of heat absorber 21 is pooled in water reservoir 29 placed under heat absorber 21, and then drained through drain hose 11 to the outside of the washer/dryer by drain pump 31.

As discussed above, use of the heat-exchange operation of heat pump 30 for drying clothes 4 allows heat absorber 21 to dehumidify a lot in an efficient manner, so that a drying efficiency can be increased, and a drying time can be reduced. As a result, energy can be saved.

Cuts 32 shaped like a dashed line are provided to the boundary between heat absorber 21 and heat radiator 23 which share fins 25 with each other, so that the heat from heat radiator 23 can travel to heat absorber 21 in an appropriate amount through small connecting sections between each one of cuts 32 even when a temperature of the refrigerant flowing through heat absorber 21 is not higher than 0° C. such as when an ambient temperature is low or the air passing through heat absorber 21 is in a low-temperature state. This appropriate amount of heat can prevent frost or ice formed on heat absorber 21 from growing. As a result, the foregoing structure allows preventing the efficiency of heat exchange between the drying air and the refrigerant from lowering even when the ambient temperature is low.

Cuts 32 can be formed along the direction (up and down direction in the drawing) of extending refrigerant pipes 21*a*, 23*a* forming meanders. This formation allows cuts 32 to be formed as one of the steps of producing a metal die of fins 25. To be more specific, through holes of the refrigerant pipe on fin 25 can be made with the metal die, and this well-known method is done this way: Fin member is fed along one direction, e.g. from left to right while the details of the metal die are changed one by one, whereby the through hole is formed step by step before completion.

The formation of cuts 32 thus only needs feeding the fin member along the same direction as forming the through-holes of the refrigerant pipes on fins 25 by the metal die. It does not need feeding the fin member along a direction different from the direction for forming the through-holes, so that the number of steps for assembling the heat exchanger can be reduced.

On top of that, heat absorber 21 and heat generator 23 are integrated together into one body as one heat exchanger, so that the heat pump can be downsized. As a result, a downsized clothes dryer excellent in drying efficiency is obtainable.

In this first embodiment, opening 1*a* for loading or taking out clothes 4 is located at a face of water tub 3 opposite to the face where motor 6 of rotary tub 5 is located; however, the location of opening 1*a* is not limited to this place, but opening 1*a* can be placed at any place of water tub 3 or rotary tub 5.

The washer/dryer is not limited to a drum-type, but it can be a vertical type using a pulsator.

A flammable refrigerant is used in heat pump 30 in this embodiment; however, a natural refrigerant such as carbon dioxide or HFC-based refrigerant can be used. Compressor 26 is not limited to the vertical type, but it can be a horizontal type.

Embodiment 2

Figure 6:
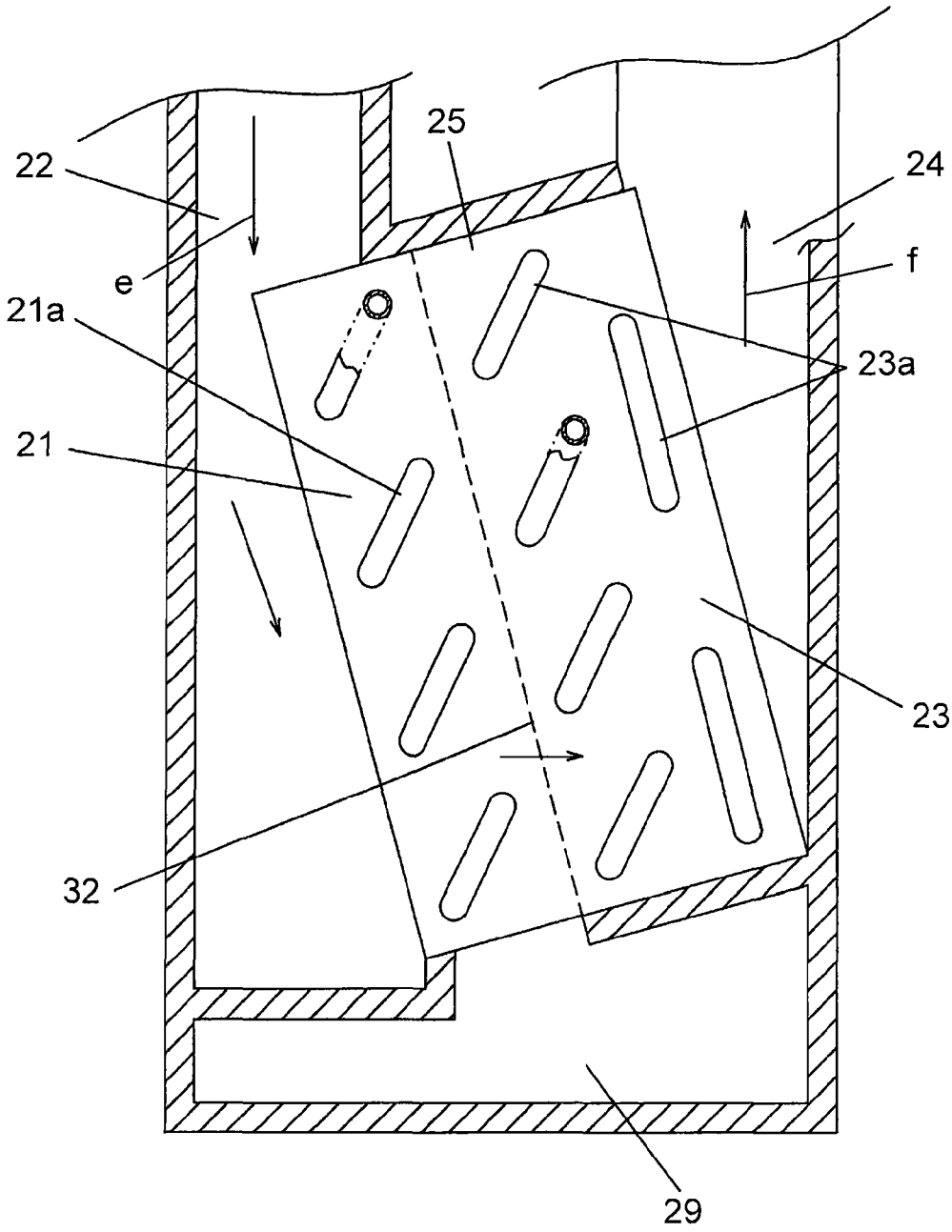
FIG. 6 shows an enlarged sectional view of a heat exchange air-flow path in a washer/dryer in accordance with a second embodiment of the present invention.

FIG. 6 shows an enlarged sectional view of a heat exchange air-flow path of a washer/dryer in accordance with the second embodiment of the present invention. Elements similar to those in embodiment 1 have the same reference signs and the descriptions thereof in detail are omitted here.

In this second embodiment, heat absorber 21 and heat radiator 23 are placed slantingly such that the lowest portion of heat absorber 21 is located somewhat lower than the lowest portion of heat radiator 23. This structure allows preventing the dew water formed on absorber 21 from moving toward radiator 23, so that the dew water attached to absorber 21 can travel smoothly to water reservoir 29. As a result, heat radiator 23 can be prevented from lowering the temperature due to water-splash from absorber 21 to radiator 23, and a washer/dryer excellent in drying efficiency is obtainable.

In a case where a heat exchanger or fin 25 differing in shape is used, a slant placement of heat absorber 21 such that the lowest portion of absorber 21 is located lower than the lowest portion of heat radiator 23 can produce an advantage similar to what is discussed above.

Embodiment 3

Figure 7:
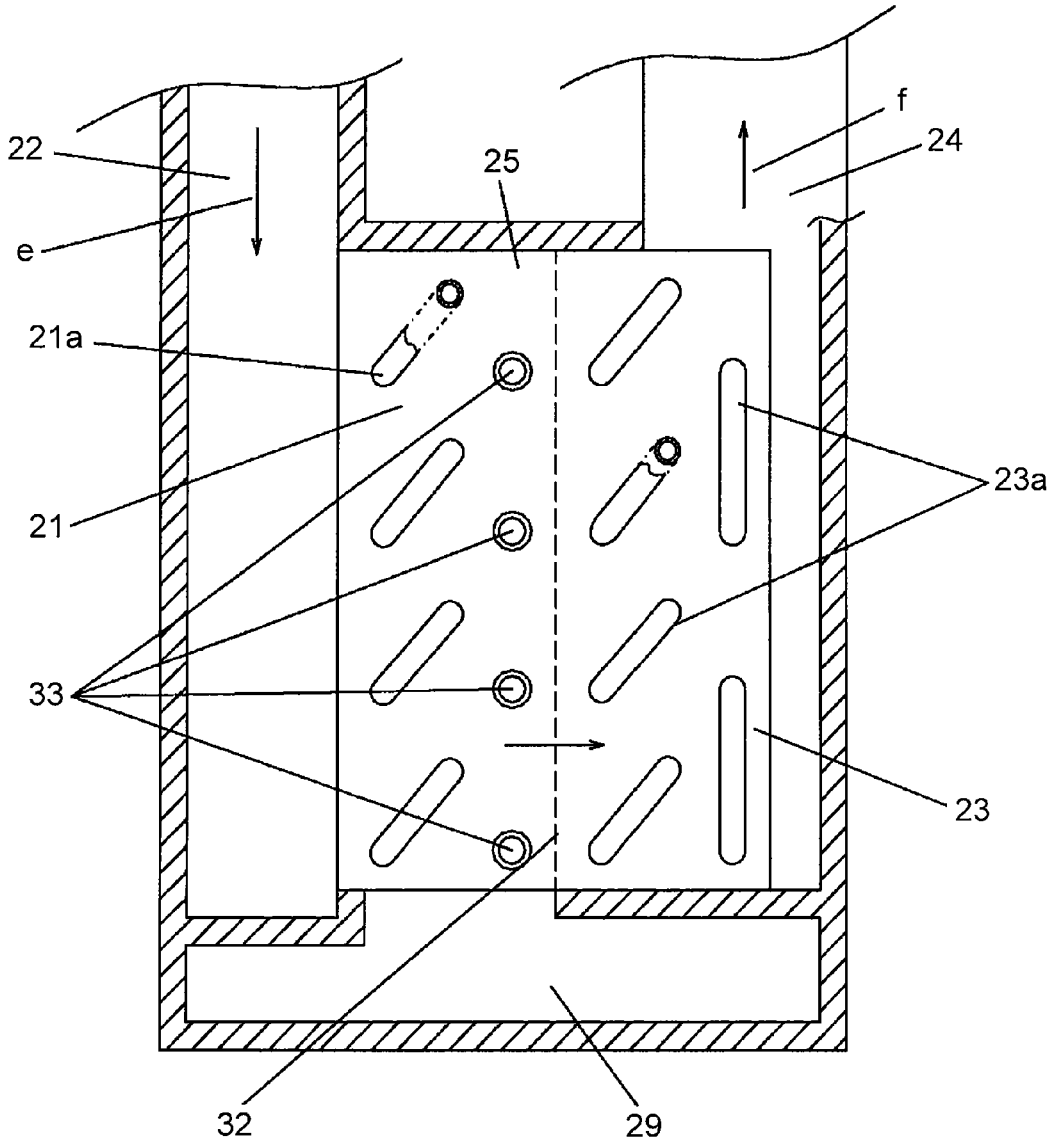
FIG. 7 shows an enlarged sectional view of a heat exchange air-flow path in a washer/dryer in accordance with a third embodiment of the present invention.

FIG. 7 shows an enlarged sectional view of a heat exchange air-flow path of a washer/dryer in accordance with the third embodiment of the present invention. Elements similar to those in embodiment 1 have the same reference signs and the descriptions thereof in detail are omitted here.

In this third embodiment, the placement of refrigerant pipe 21*a* of heat absorber 21 is the same as heat radiator 23. To be more specific, there are two rows of pipes 21*a*, namely one row extends vertically and includes refrigerant pipe 21*a* slanting, forming meanders, and running through fins 25, and the other row runs through fins 25, stands upright, and extends vertically. However, the refrigerant pipe belonging to the row standing upright and extending vertically is cancelled, and through-hole 33 left vacant intentionally (the refrigerant pipe does not run through).

The foregoing structure allows leaving a large space between absorber 21 and radiator 23, so that the dew water generated on absorber 21 can be prevented more positively from moving to radiator 23, and the dew water can be led more smoothly to water reservoir 29. As a result, heat radiator 23 can be prevented more positively from lowering the temperature caused by water-splash from absorber 21 to radiator 23, and the temperature of heat radiator 23 can be maintained at a high level, and a washer/dryer excellent in drying efficiency is obtainable.

Through-holes 33, which are supposed to be used for the refrigerant pipe to run through, are used for suppressing the heat transfer between heat absorber 21 and heat radiator 23, whereby the temperature of radiator 23 can be maintained at a high level. As a result, the drying efficiency can be prevented from lowering.

Embodiment 4

Figure 8:
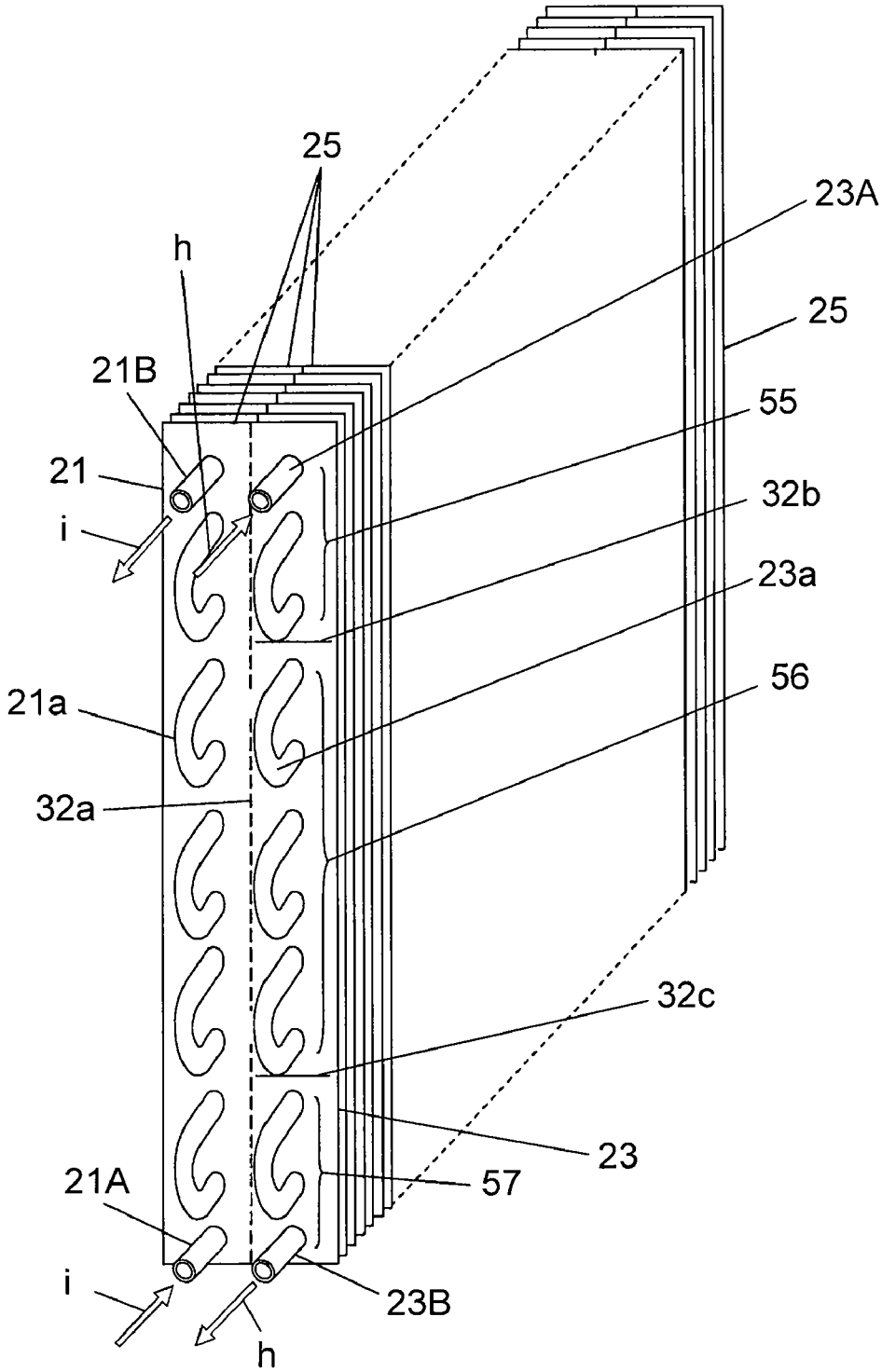
FIG. 8 shows a perspective view of a heat exchanger formed of a heat absorber and a heat radiator of a washer/dryer in accordance with a fourth embodiment of the present invention.
Figure 9:
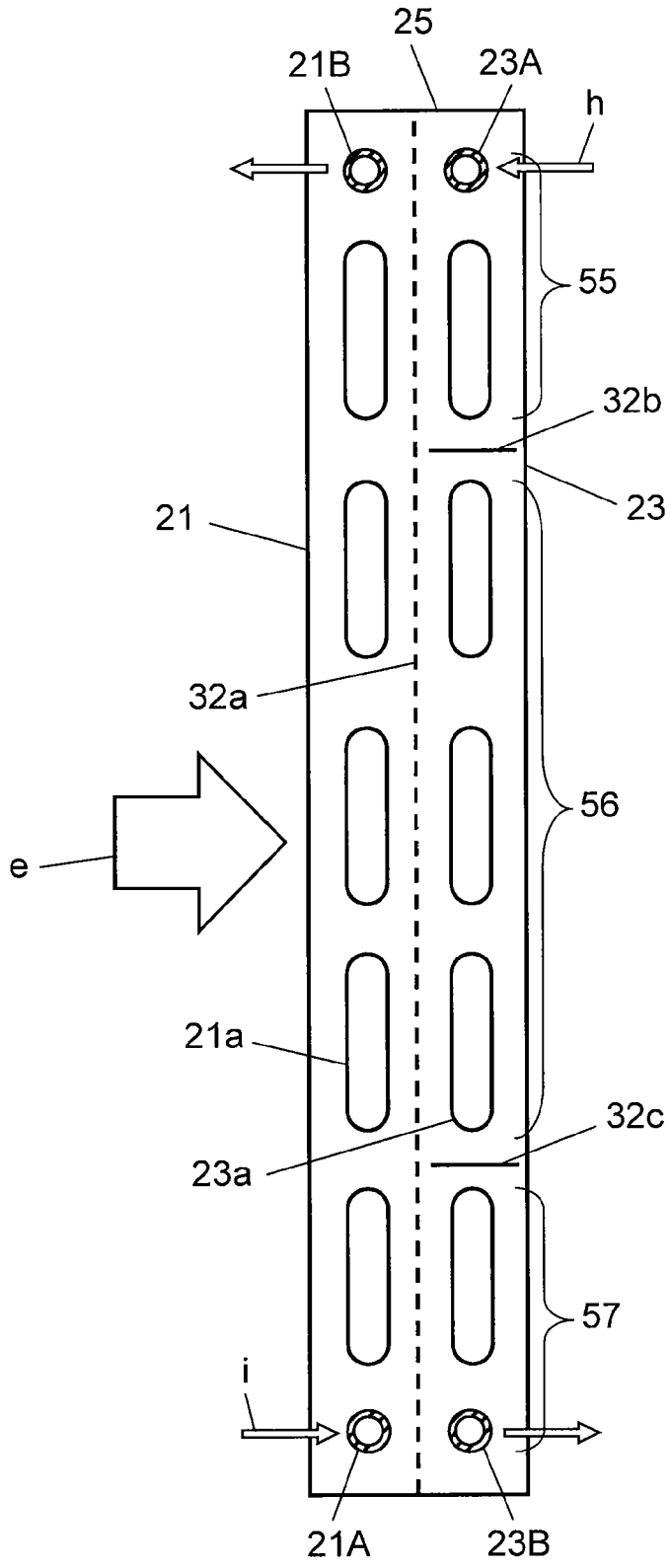
FIG. 9 shows a lateral view of the heat exchanger.

FIG. 8 shows a perspective view of a heat exchanger formed of a heat absorber and a heat radiator of a washer/dryer in accordance with the fourth embodiment of the present invention. FIG. 9 shows a lateral view of the heat exchanger. Elements similar to those used in the preceding embodiments have the same reference signs and the descriptions thereof in detail are omitted here. The drawings relevant to the first embodiment are used for describing the flow of a refrigerant.

In FIGS. 8 and 9, both of heat absorber 21 and heat radiator 23 of the heat exchanger are formed of one row of meandering refrigerant pipe 21*a* and another row of meandering pipe 23*a*, and the two rows extend in a vertical direction (as shown in the Figs.) respectively. The rows run through flat fins 25. Refrigerant entrance 21A and refrigerant exit 21B of heat absorber 21 are not adjacent to each other, but they are most distantly placed away from each other. Refrigerant entrance 23A and exit 23B of heat radiator 23 are placed in a similar way. If they are obliged to be placed close to each other because of some design factor, it must be taken into consideration that they must not placed adjacently to each other. Arrow marks "h" and "i" indicate the flows of the refrigerant in radiator 23 and absorber 21.

Cuts 32*a* are formed like a dashed line on the boundary between heat absorber 21 and heat radiator 23 on fins 25, and the line of cuts 32*a* extends along refrigerant pipes 21*a*, 23*a* (vertical direction in the Figs.) Cuts 32*a* in a dashed line are intermitted with small parts in spots in order to prevent fins 25 from being readily broken into parts by cuts 32*a*.

Cuts 32*a* are not necessarily shaped like a dashed line, but they can be a sequence of slits having a given length and intermittently formed, or a sequence of cutouts having a very narrow width and punched out by a metal die on fins 25 at the same places as cuts 32*a* intermittently.

Slit-like cut 32*b* is formed on the boundary between refrigerant overheated region 55 at refrigerant entrance 23A side of heat radiator 23 and refrigerant two-phase region 56. Overheated region 55 refers to a region where the temperature of the refrigerant is higher than the saturation temperature, and two-phase region 56 refers to the region where the temperature of the refrigerant is the saturation temperature. Cut 32*b* is formed along a direction (right-left direction) crossing the direction of refrigerant pipe 23*a* which extends in a meanders manner (vertical direction). Cut 32*b* corresponds to the heat-transfer reducing section on the overheated region side of the present invention. Cut 32*b* can be a dashed line or cutouts similar to cut 32*a*.

On top of that, slit-like cut 32*c* is formed on the boundary between refrigerant overcooled region 57 at refrigerant exit 23B side of heat radiator 23 and refrigerant two-phase region 56. Overcooled region 57 refers to a region where the temperature of the refrigerant is lower than the saturation temperature. Cut 32*c* is formed along a direction, like cut 32*b*, crossing the direction of refrigerant pipe 23*a* which extends in a meanders manner. Cut 32*c* corresponds to the heat-transfer reducing section on the overcooled region side of the present invention. Cut 32*c* can be a dashed line or a cutout similar to cut 32*a*.

In the drying step of the washer/dryer equipped with the heat exchanger discussed above, the refrigerant compressed by compressor 26 enters at refrigerant entrance 23A of heat radiator 23 as shown with arrow mark "h", and reaches heat absorber 21 through exit 23B and throttling section 27. Then the refrigerant enters at entrance 21A and flows through exit 21B to compressor 26.

The wind generated by blower 12 blows along arrow mark "e" in FIG. 9, and when the wind passes through heat absorber 21, the water contained in the wind forms dew on absorber 21. Then the wind is warmed when it passes through heat radiator 23 and turns into dry air at a high temperature, so that this dry air serves clothes 4 in rotary tub 5 to dry.

The presence of cuts 32*a* shaped like a dashed line on the boundary between heat absorber 21 and heat radiator 23 of the heat exchanger allows reducing the heat transfer from radiator 23 to absorber 21. Absorber 21 and radiator 23 can be thus prevented from lowering the efficiency caused by the heat transfer. On the other hand, heat quantity necessary for preventing the frost or ice formed on absorber 21 from growing can be conveyed from radiator 23 to absorber 21 through the small connecting sections between each one of cuts 32*a*.

As a result, the forming of frost on heat absorber 21 can be suppressed when the ambient temperature (the temperature of the air passing through absorber 21 and radiator 23) is low, and the heat exchanging efficiency between the drying air and the refrigerant can be prevented from lowering.

The presence of cut 32*b* allows reducing the heat transfer between refrigerant two-phase region 56 and refrigerant overheated region 55 of which temperature is greatly higher than that of region 56. The presence of cut 32*c* also allows reducing the heat transfer between refrigerant two-phase region 56 and refrigerant overcooled region 57 of which temperature is lower than that of two-phase region 56. As a result, the air passing through overheated region 55 and two-phase region 56 in heat radiator can be heated efficiently.

In other words, cut 32*b* prevents overheated region 55 from lowering the temperature due to the heat transfer from overheated region 55 to two-phase region 56, so that a difference in temperature between the air and the refrigerant can be increased. Cut 32*c* prevents the heat transfer to overcooled region 57, which is thus hardly affected by the heat from two-phase region 56 and overheated region 55 that has a higher temperature.

As a result, in overcooled region 57, the refrigerant can be so overcooled that it tends to be stable in liquid state. The temperature in overheated region 55 indeed drops due to the heat transfer; however, the drop of temperature can be suppressed, so that the air passing through heat radiator 23 can be heated efficiently. The dew can be thus readily formed on heat absorber 21 so that the drying air at a high temperature is obtainable, and the drying performance can be thus stabilized.

On top of that, when the air passing through radiator 23 is at a high temperature, it is difficult for the refrigerant to be overcooled on radiator 23 side, so that the refrigerant in the two-phase state flows into throttling section 27. In such a case, a smaller quantity of refrigerant circulates and the temperature of heat absorber 21 rises, so that a smaller quantity of dew is formed on absorber 21.

However, as discussed previously, the small connecting sections between each one of cuts 32*a* shaped like a dashed line allows the heat to travel, so that the frost formation on absorber 21 can be suppressed when the temperature is low, and yet, the small connecting sections allow the heat to travel between absorber 21 and radiator 23 even when the temperature of the air is high. As a result, the heat transfer from the overheated region to the overcooled region can be reduced, and also the environment, where the refrigerant can be readily stabilized in the liquid state at refrigerant exit 23B of heat radiator 23, can be formed. The refrigerant in liquid state thus flows into throttling section 27.

The refrigerant having undergone throttling section 27 turns into the two-phase state where liquid and gas are mixed, and then flows into heat absorber 21, which deprives the refrigerant of heat. Therefore, in a case where the air temperature is high, the dew can be formed on absorber 21, so that the drying air is obtainable.

In this fourth embodiment, cut 32*b* is formed between refrigerant overheated region 55 and refrigerant two-phase region 56, and cut 32*c* is formed between refrigerant overcooled region 57 and two-phase region 56. However, overcooled region 57 can be greater according to the properties of the heat exchanger, then cut 32*c* in overcooled region 57 can be eliminated.

The heat exchanger in accordance with this fourth embodiment can be placed slantingly, as it is done in embodiment 2, in the heat exchange air-flow path which connects heat absorbing air-flow path 22 to heat radiating air-flow path 24. This structure also produces advantages similar to what are discussed above.

Overheated region 55, two-phase region 56 and overcooled region 57 in FIGS. 8 and 9 are defined univocally, and the locations thereof can be changed depending on the properties of the heat exchanger. Therefore, the locations of cut 32*b* and cut 32*c* can be set in response to the state of the heat exchanger where a volume of heat load and a heat-pump cycle are stabilized.

Embodiment 5

Figure 10:
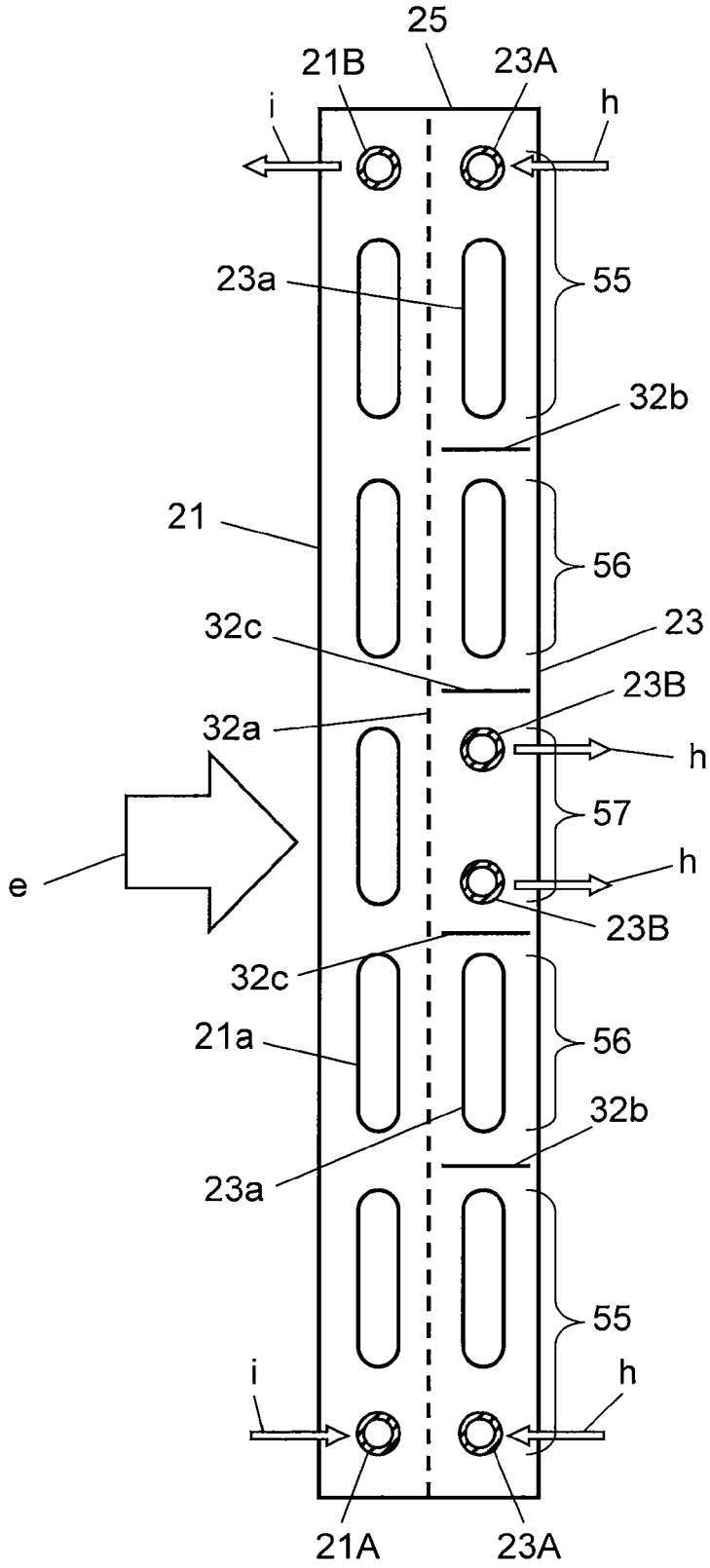
FIG. 10 shows a lateral view of a heat exchanger formed of a heat absorber and a heat radiator of a washer/dryer in accordance with a fifth embodiment of the present invention.

FIG. 10 shows a lateral view of a heat exchanger formed of a heat absorber and a heat radiator of a washer/dryer in accordance with the fifth embodiment of the present invention. Elements similar to what are used in the preceding embodiments have the same reference marks, and the descriptions thereof in detail are omitted here. The drawings relevant to the first embodiment are used for describing the flow of a refrigerant as they are used in the previous embodiment.

As shown in FIG. 10, heat radiator 23 of the heat exchanger includes two independent rows of refrigerant pipes 23*a* which form meanders and extend along one direction (vertical direction in FIG. 10). The two rows are placed on one straight line respectively, and each row extends through fins 25, so that two circuits are formed. Refrigerant entrance 23A and refrigerant exit 23B of heat radiator 23 are placed at two places respectively not adjacent to each other.

Cuts 32*a* (heat-transfer reducing section) are formed on the boundary between heat absorber 21 and heat radiator 23, and cut 32*b* is formed on the boundary between refrigerant overheated region 55 and refrigerant two-phase region 56, cut 32*c* is formed on the boundary between two-phase region 56 and refrigerant overcooled region 57. Cut 32*b* is referred to a heat-transfer reducing section on the overheated region side, and cut 32*c* is referred to a heat-transfer reducing section on the overcooled region side. Heat absorber 21 uses the same structure as that used in embodiment 4.

In the drying step of the washer/dryer equipped with the foregoing heat exchanger, wind from blower 12 flows along arrow mark "e" in FIG. 10, and when the wind (air) runs through heat absorber 21, the water contained in the air form dew on absorber 21. Then the air is warmed and dried when it travels through heat radiator 23, and the air serves the clothes in rotary tub 5 to dry.

In this state, the refrigerant is discharged from compressor 26, and then divided as indicated with arrow marks "h", namely, the refrigerant enters at entrances 23A located at the upper and lower ends in FIG. 10, and flows to exits 23B located at the center in FIG. 10. Then the refrigerant joins to each other and flows to absorber 21 via throttling section 27, and then the refrigerant flows at entrance 21A to exit 21B, and reaches compressor 26 as indicated with arrow mark "i". During the foregoing course, refrigerant overheated region 55, two-phase region 56, and overcooled region 57 are formed in heat radiator 23.

The presence of cuts 32*a* shaped like a dashed line and formed on the boundary between absorber 21 and radiator 23 allows the heat transfer from radiator 23 to absorber 21 to decrease, and thus the lowering in efficiency, caused by the heat transfer, of absorber 21 and radiator 23 can be prevented. On the other hand, the heat can travel from radiator 23 to absorber 21 through the small connecting sections formed between each one of cuts 32*a* shaped like a dashed line, thereby preventing frost or ice formed on absorber 21 from growing.

As a result, the lowering of the efficiency in heat exchange between the drying air and the refrigerant can be suppressed in a case where the ambient air temperature (the temperature of the air traveling through radiator 23 and absorber 21) is low.

The presence of cut 32*b* allows reducing the heat transfer between refrigerant two-phase region 56 and refrigerant overheated region 55 of which temperature is greatly higher than that of region 56. The presence of cut 32*c* also allows reducing the heat transfer between refrigerant two-phase region 56 and refrigerant overcooled region 57 of which temperature is lower than that of two-phase region 56. As a result, the air passing through overheated region 55 and two-phase region 56 in heat radiator 23 can be heated efficiently.

As a result, similar to embodiment 4, in overcooled region 57, the refrigerant can be so overcooled that it tends to be stable in liquid state, and the air passing through heat radiator 23 can be heated efficiently. The dew can be thus readily formed on heat absorber 21, so that the drying performance can be stabilized.

On top of that, in a case where the temperature of the air passing through radiator 23 is high, the heat can travel through the small connecting sections formed between each one of cuts 32*a* shaped like a dashed line, so that the refrigerant at exit 23B of radiator 23 turns into liquid, and the drying air can be thus obtained due to the dew formed by cooling operation of absorber 21 and a temperature-rise (heating) by radiator 23.

Refrigerant overcooled region 57 can be greater according to the properties of the heat exchanger, then cut 32*c* in overcooled region 57 can be eliminated. The heat exchanger in accordance with this fifth embodiment can be placed slantingly, as it is done in embodiment 2, in the heat exchange air-flow path which connects heat absorbing air-flow path 22 to heat radiating air-flow path 24. This structure also produces advantages similar to what are discussed above.

Overheated region 55, two-phase region 56 and overcooled region 57 in FIG. 10 are defined univocally, and the locations thereof can be changed depending on the properties of the heat exchanger. Therefore, the locations of cut 32*b* and cut 32*c* can be set in response to the state of the heat exchanger where a volume of heat load and a heat-pump cycle are stabilized.

Embodiment 6

Figure 11:
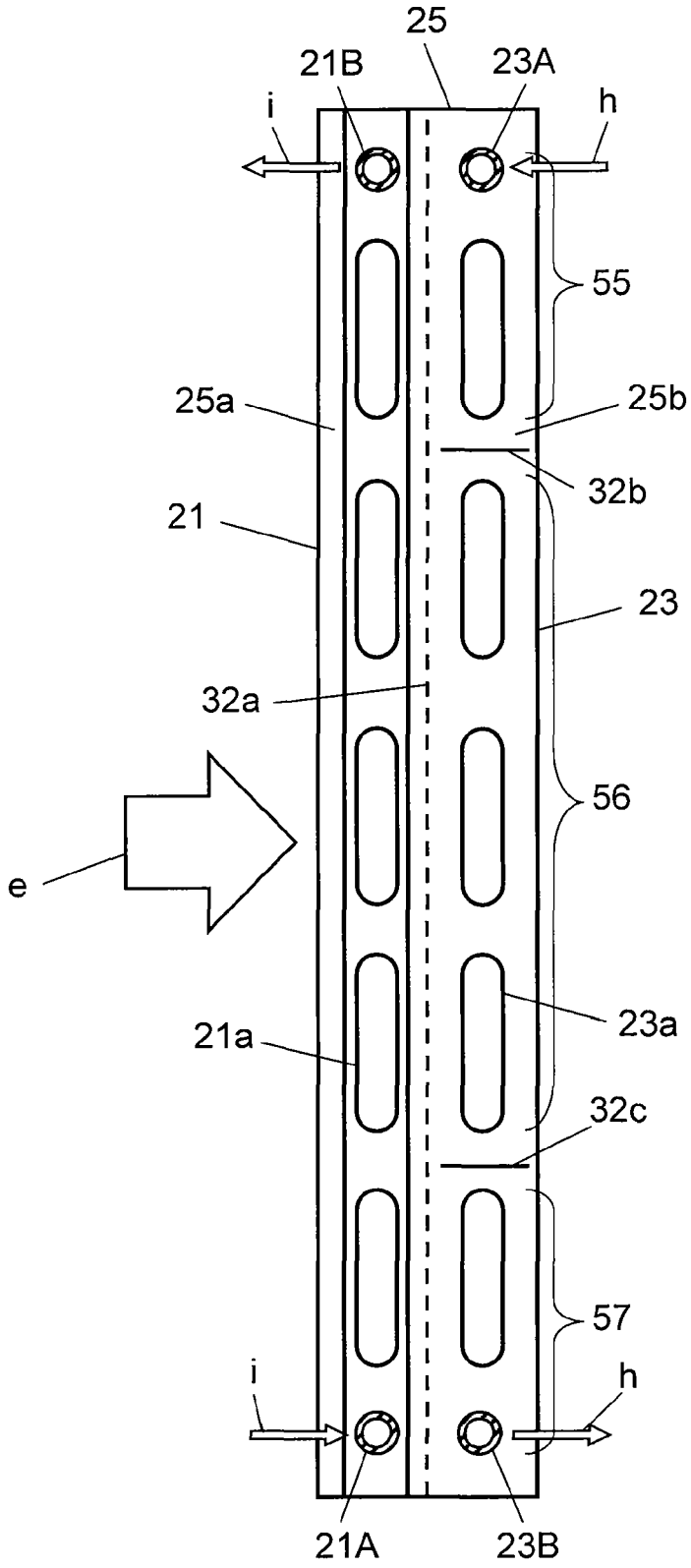
FIG. 11 shows a lateral view of a heat exchanger formed of a heat absorber and a heat radiator of a washer/dryer in accordance with a sixth embodiment of the present invention.

FIG. 11 shows a lateral view of a heat exchanger formed of a heat absorber and a heat radiator of a washer/dryer in accordance with the sixth embodiment of the present invention. Elements similar to what are used in the preceding embodiments have the same reference marks, and the descriptions thereof in detail are omitted here. The drawings relevant to the first embodiment are used for describing the flow of a refrigerant as they are used in the previous embodiment.

In FIG. 11, the heat exchanger is formed of elements similar to those of embodiment 4; however, it greatly differs from embodiment 4 in the structure of fin 25. In this sixth embodiment, fin 25*a* on heat absorber 21 side forms a corrugated-fin, and fin 25*b* on heat radiator 23 side forms a flat-fin; however, fin 25*b* is not necessarily a flat one.

In the drying step of the washer/dryer equipped with the heat exchanger discussed above, the refrigerant compressed by compressor 26 enters at refrigerant entrance 23A of heat radiator 23 as shown with arrow mark "h", and reaches heat absorber 21 through exit 23B and throttling section 27. Then the refrigerant enters at entrance 21A and flows through exit 21B to compressor 26.

The wind generated by blower 12 blows along arrow mark "e" in FIG. 11, and when the wind passes through heat absorber 21, the water contained in the wind forms dew on absorber 21. Then the wind is warmed when it passes through heat radiator 23 and turns into dry air at a high temperature, so that this wind serves clothes 4 in rotary tub 5 to dry.

The presence of corrugated-fin 25*a* on absorber 21 side, where dew is to be formed, allows producing an advantage similar to that produced in embodiment 4, and corrugated-fin 25*a* allows the dew water formed on absorber 21 to drain away along the gravity direction with ease. Corrugated-fin 25*a* makes the dew water attached thereto resist flowing into heat radiator 23 placed down the wind because the dew water tends to be pushed by the air current, so that the dew water is prevented from re-evaporating from radiator 23. As a result, higher drying performance is achievable.

The heat exchanger in accordance with this sixth embodiment can be placed slantingly, as it is done in embodiment 2, in the heat exchange air-flow path which connects heat absorbing air-flow path 22 to heat radiating air-flow path 24. This structure also produces advantages similar to what are discussed above.

The refrigerant path in heat radiator 23 is solely formed of refrigerant pipe 23*a*; however, multiple refrigerant pipes, in which the refrigerant flows in parallel, can be used instead. In this case, cuts 32*a*, 32*b*, and 32*c* also work similarly and produce advantages similar to what are discussed above.

Embodiment 7

Figure 12:
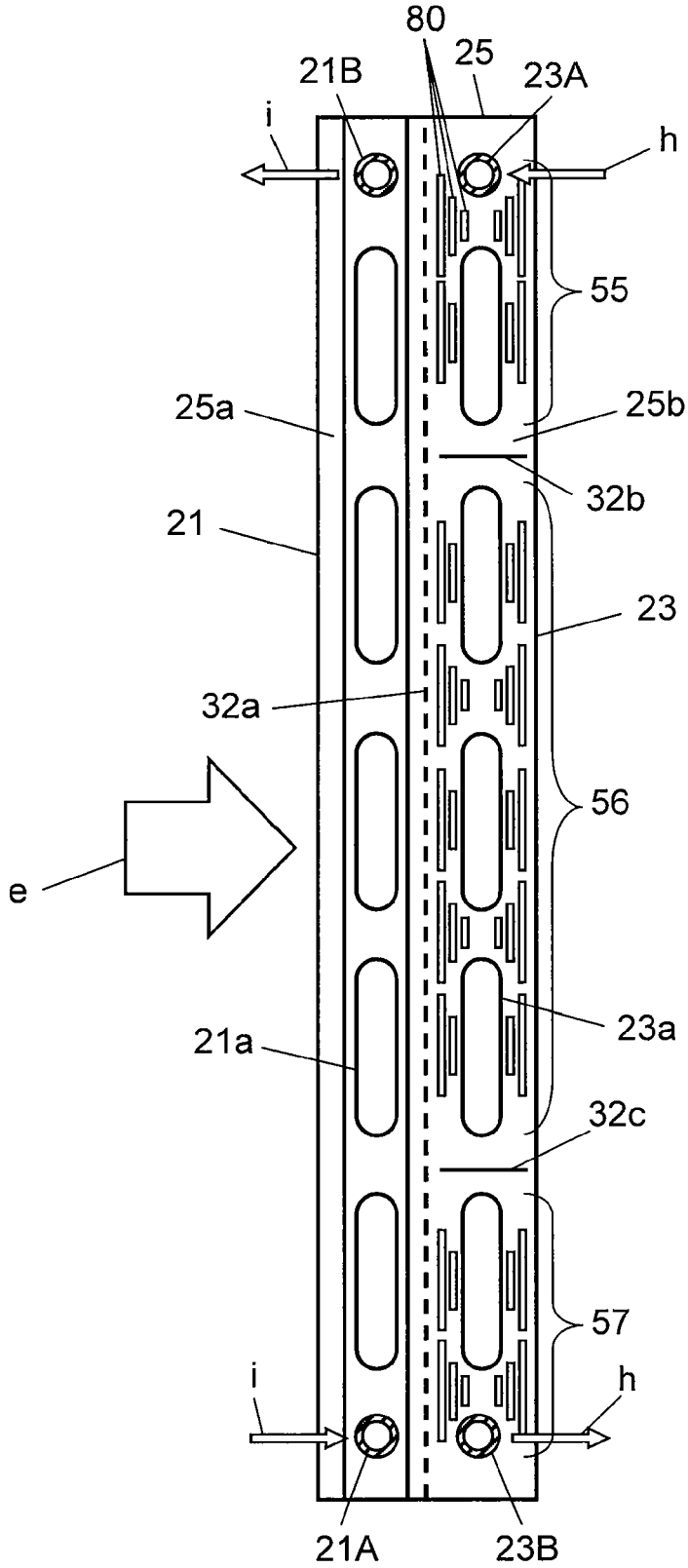
FIG. 12 shows a lateral view of a heat exchanger formed of a heat absorber and a heat radiator of a washer/dryer in accordance with a seventh embodiment of the present invention.

FIG. 12 shows a lateral view of a heat exchanger formed of a heat absorber and a heat radiator of a washer/dryer in accordance with the seventh embodiment of the present invention. Elements similar to what are used in the preceding embodiments have the same reference marks, and the descriptions thereof in detail are omitted here. The drawings relevant to the first embodiment are used for describing the flow of a refrigerant as they are used in the previous embodiment.

In FIG. 12, the heat exchanger is formed of elements similar to those of embodiment 6; however, it greatly differs from embodiment 6 in the structure of fin 25. In this seventh embodiment, fin 25*a* on heat absorber 21 side has a corrugated-fin, and fin 25*b* on heat radiator 23 side has a slit-fin having a large number of slits 80.

In the drying step of the washer/dryer equipped with the heat exchanger discussed above, the wind generated by blower 12 blows along arrow mark "e" in FIG. 12, and when the wind passes through heat absorber 21, the water contained in the wind forms dew on absorber 21. Then the wind is warmed when it passes through heat radiator 23 and turns into dry air at a high temperature, so that this wind serves clothes 4 in rotary tub 5 to dry.

Slit-fins 25*b* on radiator 23 side allows suppressing the degrading in the drying performance as seen in embodiment 5, where the degrading is caused by the flow-in of dew water attached to absorber 21 to radiator 23. On top of that, advantages similar to what are discussed in embodiment 5 can be expected, and slit-fin 25*b* can increase the heat exchange performance of heat radiator 23.

In addition to the advantages discussed above, cut 32*b* formed between refrigerant overheated region 55 and refrigerant two-phase region 56 as well as cut 32*c* formed between two-phase region 56 and overcooled region 57 can reduce the heat transfer between them, so that a temperature fall of the drying air caused by the heat transfer can be suppressed.

In a case where the temperature of the air flowing through the heat exchanger is high or low, an appropriate heat conduction can be done through the small connecting sections between each one of cuts 32*a* formed between absorber 21 and radiator 23. This appropriate heat conduction allows reducing frost formed on absorber 21, or suppressing the reduction in the overcooled region. As a result, the drying performance can be prevented from lowering.

The heat exchanger in accordance with this seventh embodiment can be placed slantingly, as it is done in embodiment 2, in the heat exchange air-flow path which connects heat absorbing air-flow path 22 to heat radiating air-flow path 24. This structure also produces advantages similar to what are discussed above.

The refrigerant path in heat radiator 23 is solely formed of refrigerant pipe 23*a*; however, multiple refrigerant pipes in which the refrigerant flows in parallel can be used instead. In this case, cuts 32*a*, 32*b*, and 32*c* also work similarly and produce advantages similar to what are discussed above.

Embodiment 8

Figure 13:
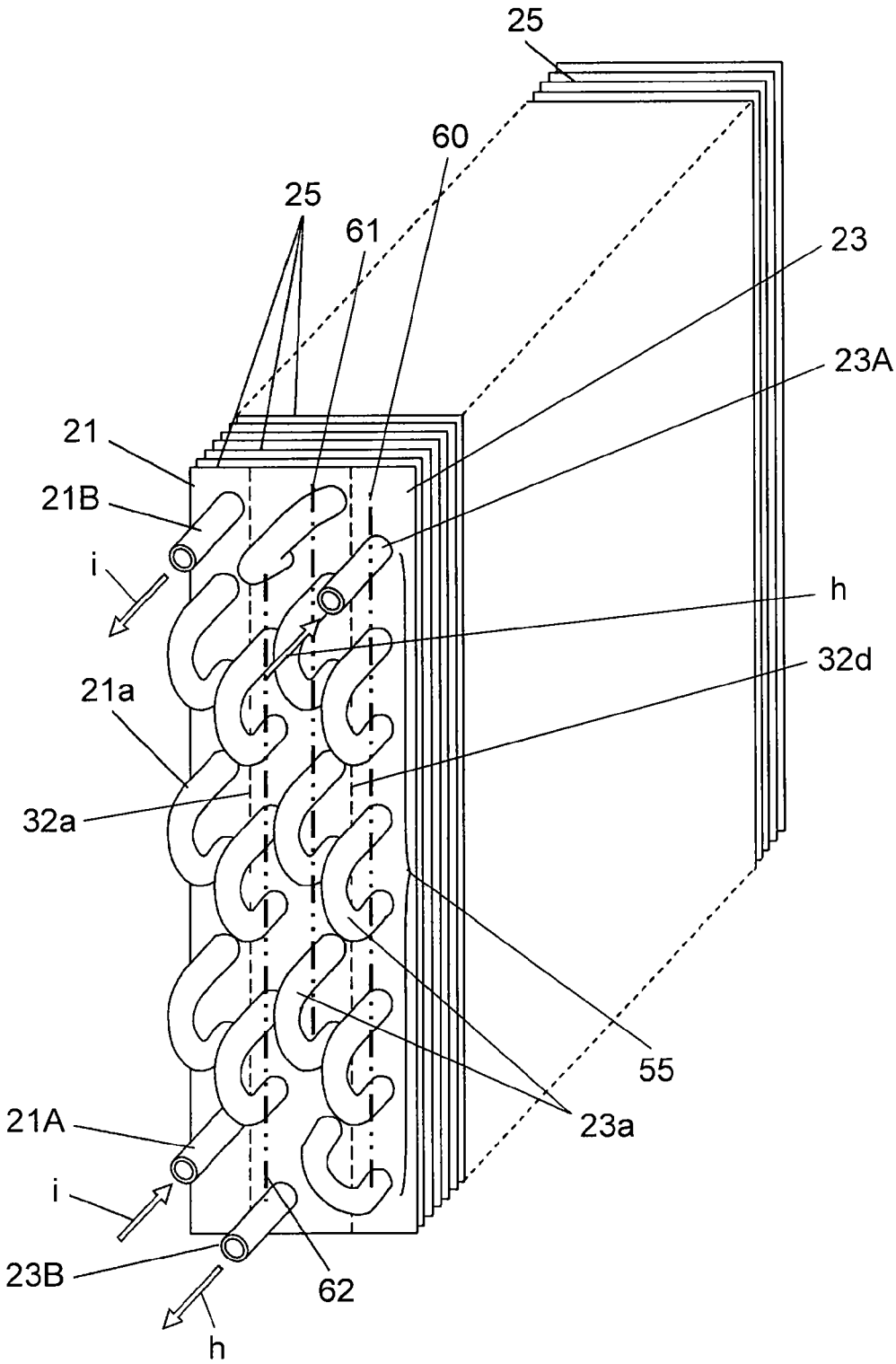
FIG. 13 shows a perspective view of a heat exchanger formed of a heat absorber and a heat radiator of a washer/dryer in accordance with an eighth embodiment of the present invention.
Figure 14:
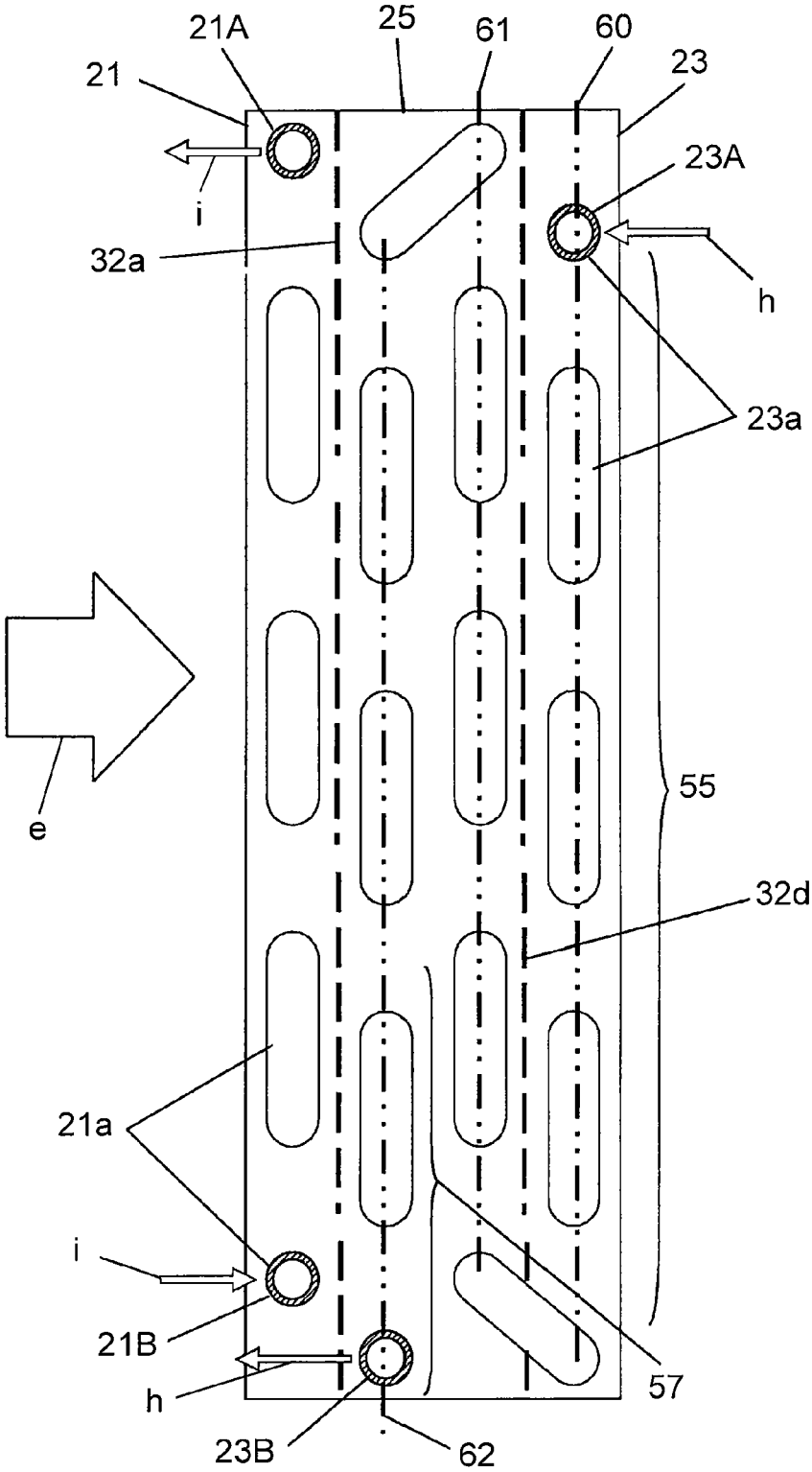
FIG. 14 shows a lateral view of the heat exchanger.

FIG. 13 shows a perspective view of a heat exchanger formed of a heat absorber and a heat radiator of a washer/dryer in accordance with the eighth embodiment of the present invention. FIG. 14 shows a lateral view of the heat exchanger. Elements similar to what are used in the preceding embodiments have the same reference marks, and the descriptions thereof in detail are omitted here. The drawings relevant to the first embodiment are used for describing the flow of a refrigerant as they are used in the previous embodiment.

As shown in FIGS. 13 and 14, heat absorber 21 of the heat exchanger includes one row of meandering refrigerant pipe 21*a* extending along one direction, and pipe 21*a* arranged vertically runs through flat-fins 25 shared by heat absorber 21 and heat radiator 23.

Heat radiator 23 of the heat exchanger includes multiple rows 60, 61, 62 (indicated respectively with a long dashed double-short dashed line) of meandering refrigerant pipes 23*a*. Refrigerant pipes 23*a* arranged vertically extend through flat-fins 25 shared by absorber 21 and radiator 23. In other words, three rows 60, 61, 62 of refrigerant pipes 23*a* form the refrigerant-pipe rows on the heat radiating side. Both of the ends of pipe 23*a* on center row 61 are connected to first ends of pipes 23*a* on rows 60, 62 adjacent to row 61, so that a single refrigerant path on the heat radiation side is formed, whereby refrigerant entrance 23A can be placed away from refrigerant exit 23B.

Cuts 32*d* shaped like a dashed line are formed between row 60 and adjacent row 61 and along the direction (vertical direction in FIG. 13) of extending refrigerant pipe 23*a*. Row 60 includes refrigerant overheated region 55 on fins 25 of heat radiator 23 side. Cuts 32*d* refer to the heat-transfer reducing sections.

Cuts 32*a* shaped like a dashed line are formed on the boundary between heat absorber 21 and heat radiator 23 on fins 25, and cuts 32*a* extend along the extending direction of pipe 23*a*. Cuts 32*a* refer to the heat-transfer reducing sections, and reduce the heat transfer from radiator 23 to absorber 21.

Cuts 32*d* are not necessarily shaped like a dashed line, but they can be a sequence of slits having a given length and intermittently formed, or a sequence of cutouts having a very narrow width and punched out by a metal die on fins 25 at the same places as cuts 32*a* intermittently.

In the drying step of the washer/dryer equipped with the foregoing heat exchanger, the refrigerant compressed by compressor 26 enters at refrigerant entrance 23A of heat radiator 23 as indicated by arrow mark "h", and reaches heat absorber 21 through exit 23B and throttling section 27. Then the refrigerant enters at entrance 21A and flows through exit 21B to compressor 26 as indicated by arrow mark "i".

The wind generated by blower 12 blows along arrow mark "e" in FIG. 14, and when the wind passes through heat absorber 21, the water contained in the wind forms dew on absorber 21. Then the wind is warmed when it passes through heat radiator 23 and turns into dry air at a high temperature, so that this dry air serves clothes 4 in rotary tub 5 to dry.

In this state, the heat exchanger reduces an amount of the heat conduction from heat radiator 23 to heat absorber 21 because of the presence of cuts 32*a* shaped like a dashed line. On the other hand, the heat traveling through the small connecting sections formed between each one of cuts 32*a* prevents frost or ice formed on absorber 21 from growing. As a result, in a case where an ambient temperature is low or the temperature of the air passing through the heat exchanger is low, the foregoing structure can prevent the efficiency of heat exchange between the drying air and the refrigerant from lowering.

On top of that, cuts 32*d* shaped like a dashed line and formed between row 60 and row 61 allows reducing an amount of the heat conduction through fins 25 between row 60 and row 61, where row 60 includes refrigerant overheated region 55 of which temperature is greatly higher than that of the refrigerant two-phase region, and row 61 adjacent to row 60 includes the two-phase region or overcooled region 57 (shown in FIG. 14). This structure allows heating the air passing through heat radiator 23 in an efficient manner, so that the drying performance can be improved.

Cuts 32*d* greatly affect overcooled region 57 in radiator 23 when the ambient temperature of the temperature of the air passing through the heat exchanger is high.

To be more specific, as already described in embodiment 4, in a case where the temperature of the air passing through heat radiator 23 is high, it tends to be difficult to maintain the refrigerant in liquid state at overcooled region 57 in radiator 23. However, as similar to the case where the temperature is low, there is an appropriate amount of heat transfer between radiator 23 and absorber 21, and yet, cut 32*d* reduces the heat conduction from overheated region 55 to overcooled region 57. As a result, fewer factors exist in overcooled region 57 for blocking the heat transfer to/from absorber 21.

In other words, refrigerant overcooled region 57 resists being affected by the heat from overheated region 55 due to the presence of cuts 32*d*, so that a difference in temperature between overcooled region 57 and absorber 21 is small. Since the heat transfer between overcooled region 57 and absorber 21 is done in this state, i.e. there is a small difference in the temperatures, overcooled region 57 can be formed steadily in row 62.

As a result, the refrigerant turns into a liquid state at refrigerant exit 23B of radiator 23, and stays as the liquid state or turns into the two-phase state, where liquid and gas are mixed, at throttling section 27, and then flows into heat absorber 21. In the case of a high ambient temperature, the foregoing mechanism allows the temperature of heat absorber 21 to lower so that dew can be formed on absorber 21. The dehumidifying capacity can be thus maintained.

In heat radiator 23, a temperature drop at overheated region 55 caused by the heat transfer can be suppressed, so that the air passing through heat radiator can be heated efficiently.

As a result, the dew can be formed positively on heat absorber 21, and the drying air at a high temperature is obtainable, which results in an improvement in drying performance.

The locations of overheated region 55 and overcooled region 57 in accordance with embodiment 8 are univocally defined; the locations thereof can be changed depending on a shape of the fins of the heat exchanger, or the number of rows formed of meandering refrigerant pipe 23*a*. Therefore, the location of cuts 32*d* can be set in response to the structure (properties) of the heat exchanger.

The heat exchanger in accordance with this eighth embodiment can be placed slantingly, as it is done in embodiment 2, in the heat exchange air-flow path which connects heat absorbing air-flow path 22 to heat radiating air-flow path 24. This structure also produces advantages similar to what are discussed above.

Row 62 shown in FIG. 14 can be eliminated depending on the properties and capacity of the heat exchanger, and the through-holes (not shown) for the refrigerant pipes can be used for reducing the heat transfer from radiator 23 to absorber 21 as they are used in embodiment 3.

In this eighth embodiment, flat-fins 25 are used; however, the fins at absorber 21 can be corrugated as seen in embodiments 5 and 6. In this case, dew water formed on absorber 21 drains along the gravity direction with ease, and the dew water resists flowing into heat radiator 23 placed down the wind because the dew water tends to be pushed by the air current, so that the dew water is prevented from re-evaporating from radiator 23. As a result, the washer/dryer more excellent in drying performance is achievable.

Fins 25 at heat radiator 23 can be slit-fins, so that the capacity of heat exchange between the air and the refrigerant can be increased, thereby enhancing the drying performance.

Fins 25 at absorber 21 can be corrugated-fins, and those at radiator 23 can be slit-fins, whereby the heat exchanger excellent in drainage performance and heat exchange performance is achievable.

The refrigerant flow-path in heat radiator 23 is formed of multiple rows of flow-paths solely formed of refrigerant pipe 23*a*; however, as described in embodiment 5, multiple refrigerant flow-paths can be placed vertically or horizontally so that the refrigerant can flow in parallel. In this case, cuts 32*a* and cuts 32*d* can be formed similarly to the foregoing structure for producing advantages similar to what are discussed above.

Cuts 32*a* and cuts 32*d* used in embodiment 8 are formed at different intervals in places so that fins 25 cannot be broken into parts by those cuts 32*a*, and 32*d*.

Embodiment 9

Figure 15:
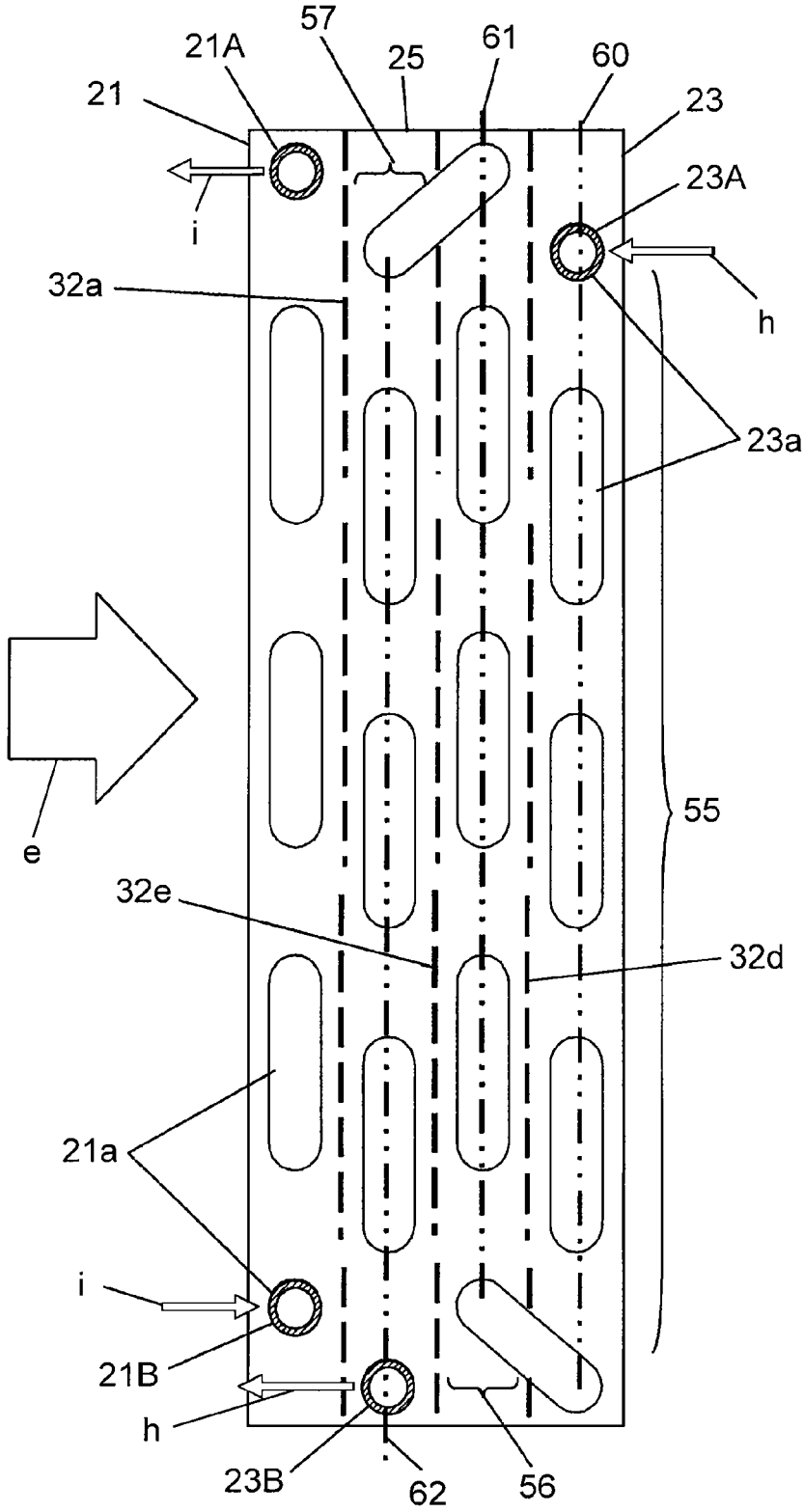
FIG. 15 shows a lateral view of a heat exchanger formed of a heat absorber and a heat radiator of a washer/dryer in accordance with a ninth embodiment of the present invention.

FIG. 15 shows a lateral view of a heat exchanger formed of a heat absorber and a heat radiator of a washer/dryer in accordance with the ninth embodiment of the present invention. Elements similar to what are used in the preceding embodiments have the same reference marks, and the descriptions thereof in detail are omitted here. The drawings relevant to the first embodiment are used for describing the flow of a refrigerant as they are used in the previous embodiment.

The heat exchanger shown in FIG. 15 includes cuts 32*e* (heat-transfer reducing sections) shaped like a dashed line in addition to the structure of the heat exchanger in accordance with embodiment 8. Cuts 32*e* are formed along the extending direction of pipes 23*a* and between row 61 and row 62 of refrigerant pipe 23*a* on fins 25 at heat radiator 25.

In the drying step of the washer/dryer equipped with the heat exchanger discussed above, the refrigerant compressed by compressor 26 enters at refrigerant entrance 23A of heat radiator 23 as indicated with arrow mark "h", and reaches heat absorber 21 through exit 23B and throttling section 27. Then the refrigerant enters at entrance 21A and flows through exit 21B to compressor 26 as indicated with arrow mark "i".

The wind generated by blower 12 blows along arrow mark "e" in FIG. 15, and when the wind passes through heat absorber 21, the water contained in the wind forms dew on absorber 21. Then the wind is warmed when it passes through heat radiator 23 and turns into dry air at a high temperature, so that this dry air serves clothes 4 in rotary tub 5 to dry.

In this state, row 60 at heat generator 23 includes refrigerant overheated region 55, and row 61 adjacent to row 60 includes refrigerant two-phase region 56, and row 62 adjacent to row 61 includes refrigerant overcooled region 57. In addition to the advantages described in embodiment 7, presence of cuts 32*e* shaped like a dashed line and formed between row 61 and row 62 allows suppressing the heat transfer via fins 25 from two-phase region 56 to overcooled region 57 of which temperature is greatly lower than that of two-phase region 56.

As discussed above, cuts 32*e* suppresses the heat transfer from two-phase region 56 and overheated region 55 to overcooled region 57 which has the lowest temperature. As a result, in addition to the advantages described in embodiment 8, overcooled region 57 can be formed more steadily in row 62.

Therefore, in a case where an ambient temperature is high or the temperature of the air passing through the heat exchanger is high, in particular, the overcooled refrigerant (liquid refrigerant) can be obtained more steadily on row 62. Dew can be also formed more readily on heat absorber 21, so that the dehumidifying capacity can be prevented from lowering.

The structure discussed above also allows suppressing a temperature drop caused by the heat transfer between overheated region 55 and two-phase region 56, so that the air dehumidified by heat absorber 21 can be heated efficiently and the drying performance can be improved.

In this ninth embodiment, flat-fins 25 are used; however, the fins at absorber 21 can be corrugated. In this case, dew water formed on absorber 21 drains along the gravity direction with ease, and the dew water resists flowing into heat radiator 23 placed down the wind because the dew water tends to be pushed by the air current, so that the dew water is prevented from re-evaporating from radiator 23. As a result, the washer/dryer more excellent in drying performance is achievable.

Fins 25 at heat radiator 23 can be slit-fins, so that the capacity of heat exchange between the air and the refrigerant can be increased, thereby enhancing the drying performance.

Fins 25 at absorber 21 can be corrugated-fins, and those at radiator 23 can be slit-fins, whereby the heat exchanger excellent in drainage performance and heat exchange performance is achievable. Fins 25 as a whole can be slit-fins.

The locations of overheated region 55, two-phase region 56, and overcooled region 57 in accordance with embodiment 9 are univocally defined; the locations thereof can be changed depending on a shape of the fins of the heat exchanger, or the number of rows formed of meandering refrigerant pipe 23*a*. Therefore, the location of cuts 32*d* and cuts 32*e* can be set in response to the structure (properties) of the heat exchanger.

The heat exchanger in accordance with this ninth embodiment can be placed slantingly, as it is done in embodiment 2, in the heat exchange air-flow path which connects heat absorbing air-flow path 22 to heat radiating air-flow path 24. This structure also produces advantages similar to what are discussed above.

Row 62 shown in FIG. 15 can be eliminated depending on the properties and capacity of the heat exchanger, and the through-holes (not shown) for the refrigerant pipe can be used for reducing the heat transfer from radiator 23 to absorber 21 as they are used in embodiment 3.

The refrigerant flow-path in heat radiator 23 is formed of multiple rows of flow-paths solely formed of refrigerant pipe 23*a*; however, as described in embodiment 5, multiple refrigerant flow-paths can be placed vertically or horizontally so that the refrigerant can flow in parallel. In this case, cuts 32*a*, 32*d*, and 32*e* can be formed similarly for producing advantages similar to what are discussed above.

Cuts 32*a*, cuts 32*d*, and cuts 32*e* used in embodiment 9 are formed at different intervals in places so that fins 25 cannot be broken into parts by those cuts 32*a*, 32*d*, and 32*e*.

Embodiment 10

Figure 16:
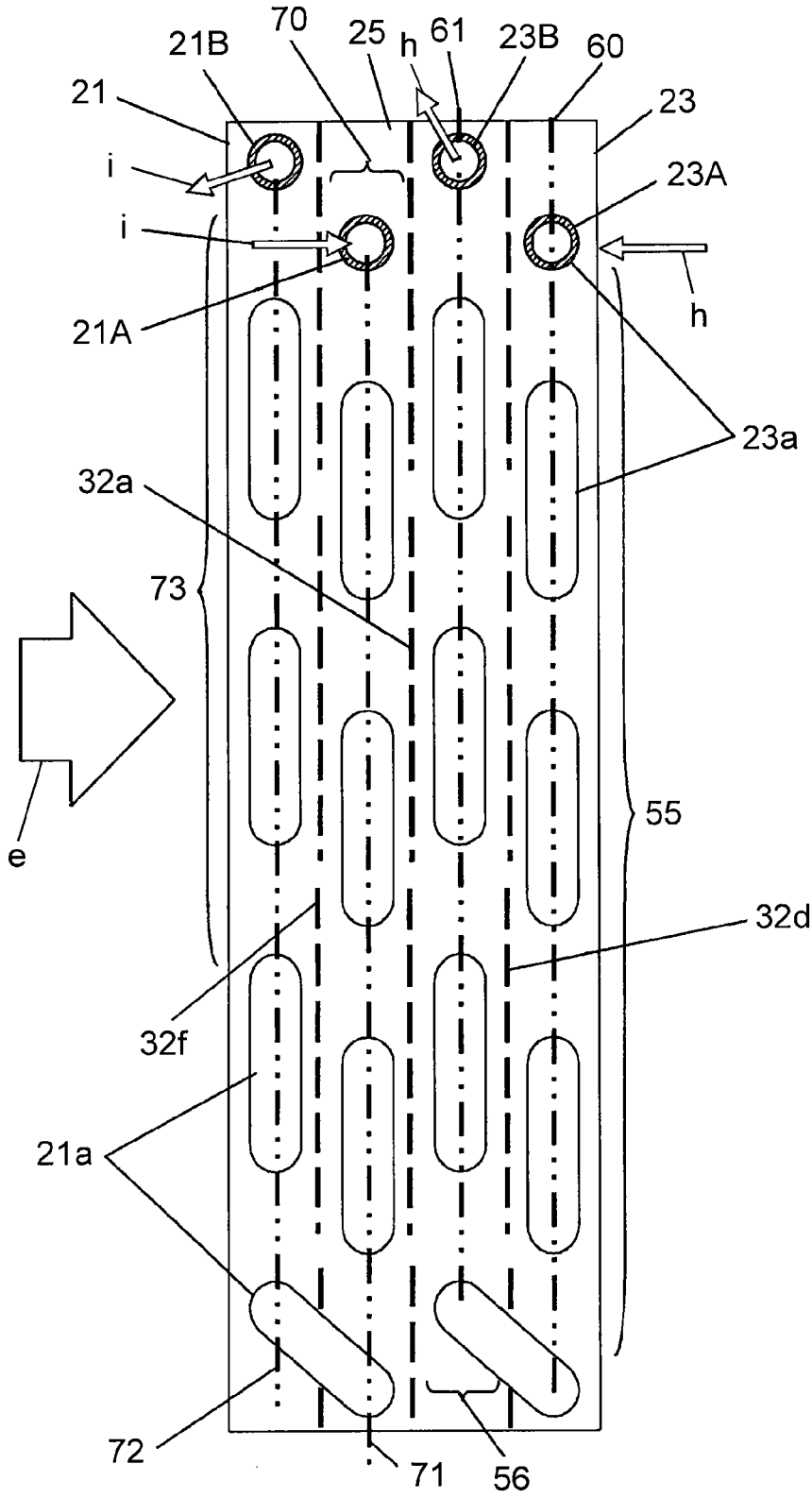
FIG. 16 shows a lateral view of a heat exchanger formed of a heat absorber and a heat radiator of a washer/dryer in accordance with a tenth embodiment of the present invention.

FIG. 16 shows a lateral view of a heat exchanger formed of a heat absorber and a heat radiator of a washer/dryer in accordance with the tenth embodiment of the present invention. Elements similar to what are used in the preceding embodiments have the same reference marks, and the descriptions thereof in detail are omitted here. The drawings relevant to the first embodiment are used for describing the flow of a refrigerant as they are used in the previous embodiment.

As shown in FIG. 16, heat absorber 21 of the heat exchanger includes two rows 71, 72 (indicated with long dashed double-short dashed line) of meandering refrigerant pipes 21*a*. The two rows extend along one direction, and are arranged vertically, and pipes 21*a* run through flat-fins 25 which are shared by absorber 21 and heat radiator 23. In other words, two rows of refrigerant pipes 21*a* form a refrigerant pipe-row at the heat absorbing side. Pipes 21*a* of rows 71, 72 are connected to each other at their first ends, thereby forming a unit of a refrigerant flow path. Refrigerant entrance 21A and refrigerant exit 21B are placed at the upper section in FIG. 16.

Heat radiator 23 of the heat exchanger includes two rows 60, 61 (indicated with long dashed double-short dashed line) of meandering refrigerant pipes 23*a*. The two rows extend along one direction, and are arranged vertically, and pipes 23*a* run through flat-fins 25 which are shared by absorber 21 and heat radiator 23. Pipes 23*a* of rows 60, 61 are connected to each other at their first ends, thereby forming a unit of a refrigerant flow path. Refrigerant entrance 23A and refrigerant exit 23B are placed at the upper section in FIG. 16.

Cuts 32*a* shaped like a dashed line are formed on the boundary between absorber 21 and radiator 23 on fins 25, and cuts 32*a* (heat-transfer reducing sections) extends along the extending direction of refrigerant pipes 21*a* and 23*a* (vertical direction). Cuts 32*a* thus reduce the heat transfer from radiator 23 to absorber 21.

Cuts 32*d* shaped like a dashed line are formed between row 60 including refrigerant overheated region 55 and row 61 adjacent to row 60. Row 61 can include refrigerant two-phase region 56 or overcooled region 57 depending on load. Cuts 32*d* extend along the extending direction of refrigerant pipes 23*a*, and they work as the heat-transfer reducing sections. On top of that, cuts 32*f* shaped like a dashed line are formed between row 71 and adjacent row 72. Row 71 includes a refrigerant overcooled region or a refrigerant two-phase region 70 (hereinafter referred to as a low temperature region) at absorber 21. Cuts 32*f* work as the heat-transfer reducing section at the heat absorber.

Cuts 32*f* are not necessarily shaped like a dashed line, as described in embodiment 4, but they can be a sequence of slits having a given length and intermittently formed, or a sequence of cutouts having a very narrow width and punched out by a metal die on fins 25 at similar places to cuts 32*a* intermittently.

As indicated with arrow marks "h" and "i", the refrigerant flows from radiator 23 to absorber 21, so that the water contained in the air forms dew on absorber 21, and the air passing through absorber 21 can be heated.

This tenth embodiment thus can produce the following advantage in addition to the advantages described in the ninth embodiment: Presence of cuts 32*f* shaped like a dashed line at heat absorber 21 reduces the heat conduction in heat absorber 21, i.e. the heat conduction via fins 25 between row 71 including low-temperature region 70 at a low temperature and row 72 including overheated region (hereinafter referred to as a high temperature region) 73.

In a case where row 72 has no overheated region, an evaporation temperature of the refrigerant is lowered due to a pressure drop in absorber 21, and a difference in the temperatures between rows 71 and 72 is changed. In such a case, the foregoing structure allows reducing an amount of the heat conduction via the fins between rows 71 and 72.

The refrigerant evaporates in absorber 21, therefore, abrasion loss occurs between the inner wall of the refrigerant pipe and the refrigerant, and acceleration loss caused by an increment in volume of the refrigerant is added to the abrasion loss. The pressure drop in absorber 21 is thus far greater than a pressure drop in radiator 23, so that the temperature of the refrigerant changes greatly. In this environment, cuts 32*f* at absorber 21 can produce a great effect.

As a result, heat absorber 21 increases an amount of heat exchange between the air and the refrigerant, and efficiently dehydrates the water contained in the air, so that the drying performance can be further improved.

In this tenth embodiment, flat-fins 25 are used; however, the fins at absorber 21 can be corrugated. In this case, dew water formed on absorber 21 drains along the gravity direction with ease, and the dew water resists flowing into heat radiator 23 placed down the wind because the dew water tends to be pushed by the air current, so that the dew water is prevented from re-evaporating from radiator 23. As a result, the washer/dryer more excellent in drying performance is achievable.

Fins 25 at heat radiator 23 can be slit-fins, so that the capacity of heat exchange between the air and the refrigerant can be increased, thereby enhancing the drying performance.

Fins 25 at absorber 21 can be corrugated-fins, and those at radiator 23 can be slit-fins, whereby the heat exchanger excellent in drainage performance and heat exchange performance is achievable. Fins 25 as a whole can be slit-fins.

The locations of overheated region 55, two-phase region 56, overcooled region 57 at radiator 23, and low temperature region 70, high temperature region 73 at absorber 21 in accordance with the tenth embodiment are univocally defined; the locations thereof can be changed depending on a shape of the fins of the heat exchanger, or the number of rows formed of meandering refrigerant pipes 21*a* and 23*a*. Therefore, the location of cuts 32*d* and cuts 32*f* can be set in response to the structure (properties) of the heat exchanger.

The heat exchanger in accordance with this tenth embodiment can be placed slantingly, as it is done in embodiment 2, in the heat exchange air-flow path which connects heat absorbing air-flow path 22 to heat radiating air-flow path 24. This structure also produces advantages similar to what are discussed above.

Row 71 shown in FIG. 16 can be eliminated depending on the properties and capacity of the heat exchanger, and then one row of the refrigerant flow-path is used. The through-holes (not shown) for the refrigerant pipes eliminated can be used for reducing the heat transfer from radiator 23 to absorber 21 as they are so used in embodiment 3.

The refrigerant flow-paths in absorber 21 and radiator 23 are formed of multiple rows of flow-paths solely formed of refrigerant pipes 21*a* and 23*a*; however, as described in embodiment 5, multiple refrigerant flow-paths can be placed vertically or horizontally so that the refrigerant can flow in parallel. In this case, cuts 32*a*, 32*d*, and 32*f* can be formed similarly to the foregoing structure for producing advantages similar to what are discussed above.

Cuts 32*a*, cuts 32*d*, and cuts 32*f* used in this embodiment 10 are formed at different intervals in places so that fins 25 cannot be broken into parts by these cuts 32*a*, 32*d*, and 32*f*.

Industrial Applicability

A washer/dryer of the present invention is formed of a heat absorber and heat radiator integrated together in one body, so that frost or ice produced on the heat absorber can be prevented from growing even when an ambient temperature is low. As a result, a clothes dryer excellent in drying performance or a washer/dryer equipped with the clothes dryer is obtainable.

The invention claimed is:

1. A cloth dryer comprising:

(a) a tub for accommodating clothes;

(b) a heat exchange air-flow path for circulating air in the tub;

(c) a heat pump disclosed in the heat exchange air-flow path, the heat pump including:

a compressor for compressing a refrigerant;

a heat radiator for exchanging heat between air in the heat exchange air-flow path and the refrigerant which has been compressed by the compressor and turned into a high temperature and high pressure state so that the refrigerant can radiate heat;

a throttling section for decompressing the refrigerant which has radiated the heat in the heat radiator and turned into a high pressure state;

a heat absorber for exchanging heat between the air in the heat exchange air-flow path and the refrigerant which has been decompressed in the throttling section and turned into a low temperature and low pressure state so that the refrigerant can deprive the ambient air of heat; and a pipe line for connecting the compressor, the heat radiator, the throttling section, and the heat absorber and (d) a blower for supplying the air heated in the heat radiator into the tub, wherein the heat radiator and the heat absorber include a stack of common fins for integrating the heat radiator and the heat absorber into one body, and the integrated heat radiator and absorber is disposed in the heat exchange air-flow path, wherein the heat absorber and the heat radiator are each formed with a refrigerant pipe , and the pipe forms meanders and extends through the fins generally in a stacking direction of the fins, wherein a heat-transfer reducing section is formed in the respective fins between a portion of the fins defining the heat absorber and a portion of the fins defining the heat radiator such that the heat-transfer reducing sections extend along the same direction as the pipe extends, and wherein the stack of common fins is slanted around an axis extensive in the stacking direction so that a lowest part of the heat absorber is positioned lower than a lowest part of the heat radiator.

2. The cloth dryer of claim 1, wherein the heat-transfer reducing section is disposed at least at a place where the refrigerant pipes, which form the heat absorber and the heat radiator, come close to each other.

3. The cloth dryer of claim 1, wherein a through-hole left vacant, into which the refrigerant pipe, through which the refrigerant is supposed to flow, is not inserted, is formed between the heat absorber and the heat radiator.

4. The cloth dryer of claim 1, wherein a refrigerant entrance and a refrigerant exit of the refrigerant pipe forming the heat radiator are formed at least at a place where the entrance avoids being adjacent to the exit.

5. The cloth dryer of claim 1, wherein a heat-transfer reducing section at an overheated side is disposed at least on a boundary between a refrigerant two-phase region and a refrigerant overheated region both of which exist on the fin at the heat radiator and extend along an extending direction of the refrigerant pipe, and the heat-transfer reducing section extends along a direction crossing the direction of the extending direction of the refrigerant pipe for reducing heat-transfer via the fin between the refrigerant two-phase region and the refrigerant overheated region.

6. The cloth dryer of claim 5, wherein the heat-transfer reducing section at an overheating side is formed of one of a cut and a cutout.

7. The cloth dryer of claim 1, wherein a heat-transfer reducing section at an overcooled side is disposed at least on a boundary between a refrigerant two-phase region and a refrigerant overcooled region both of which exist on the fin at the heat radiator and extend along an extending direction of the refrigerant pipe, and the heat-transfer reducing section extends along a direction crossing the direction of the extending direction of the refrigerant pipe for reducing heat-transfer via the fin between the refrigerant two-phase region and the refrigerant overcooled region.

8. The cloth dryer of claim 7, wherein the heat-transfer reducing section at an overcooling side is formed of one of a cut and a cutout.

9. The cloth dryer of claim 1, wherein at least the heat radiator is formed of a row of the refrigerant pipe disposed at the heat radiating side and formed of a plurality of refrigerant pipes which form meanders and are arranged in parallel with each other and extend along a given direction, wherein the row of the refrigerant pipes disposed at the heat radiating side forms a single refrigerant flow-path at the heat radiating side by connecting a first end of one of the pipes to a first end of another one of the pipes, wherein a heat-transfer reducing section is disposed at least between a row, having at least a refrigerant overheated region of the heat radiator, of the rows formed of the refrigerant pipes disposed at the heat radiating side, and a row adjacent to the row having a refrigerant overheated region, wherein the heat-transfer reducing section extends along the extending direction of the refrigerant pipe on the fin.

10. The cloth dryer of claim 1, wherein at least the heat radiator is formed of a row of refrigerant pipes disposed at the heat radiating side and formed of a plurality of refrigerant pipes which form meanders and are arranged in parallel with each other and extend along a given direction, wherein the row of the refrigerant pipes disposed at the heat radiating side forms a single refrigerant flow-path at the heat radiating side by connecting a first end of one of the pipes to a first end of another one of the pipes, wherein a heat-transfer reducing section is disposed at least between a row, having at least a refrigerant overcooled region of the heat radiator, of the rows formed of the refrigerant pipe disposed at the heat radiating side, and a row adjacent to the row having a refrigerant overcooled region, wherein the heat-transfer reducing section extends along the extending direction of the refrigerant pipe on the fin.

11. The cloth dryer of claim 1, wherein at least the heat absorber is formed of a row of refrigerant pipes disposed at the heat absorbing side and formed of a plurality of refrigerant pipes which form meanders and are arranged in parallel with each other and extend along a given direction, wherein the row of the refrigerant pipes disposed at the heat absorbing side forms a single refrigerant flow-path at the heat absorbing side by connecting a first end of one of the pipes to a first end of another one of the pipes, wherein a heat-transfer reducing section at a heat absorbing side is disposed at least between a row, having at least a refrigerant entrance, of the rows formed of the refrigerant pipe disposed at the heat absorbing side, and a row adjacent to the row having the refrigerant entrance, wherein the heat-transfer reducing section extends along the extending direction of the refrigerant pipe on the fin.

12. The cloth dryer of claim 11, wherein the heat-transfer reducing section at an overcooling side is formed of one of a cut and a cutout.

13. The cloth dryer of claim 1, wherein at least the fin of the heat absorber forms a corrugated fin.

14. The cloth dryer of claim 1, wherein at least the fin of the heat radiator forms a slit fin.

15. The cloth dryer of claim 1, wherein the heat-transfer reducing section is formed of one of a cut and a cutout.

* * * * *